US009033068B2

(12) United States Patent
Lee

(10) Patent No.: US 9,033,068 B2
(45) Date of Patent: May 19, 2015

(54) HAMMER BIT

(76) Inventor: Kwang Ik Lee, Seoul (KR)

( * ) Notice: Subject to any disclaimer, the term of this patent is extended or adjusted under 35 U.S.C. 154(b) by 825 days.

(21) Appl. No.: 12/602,095

(22) PCT Filed: May 20, 2008

(86) PCT No.: PCT/KR2008/002805
§ 371 (c)(1),
(2), (4) Date: Nov. 25, 2009

(87) PCT Pub. No.: WO2008/147071
PCT Pub. Date: Dec. 4, 2008

(65) Prior Publication Data

US 2010/0175928 A1 Jul. 15, 2010

(30) Foreign Application Priority Data

May 25, 2007 (KR) ..... 10-2007-0050671
Aug. 10, 2007 (KR) ..... 10-2007-0080516

(51) Int. Cl.
*E21B 10/32* (2006.01)
*E21B 10/36* (2006.01)

(52) U.S. Cl.
CPC ..... *E21B 10/32* (2013.01); *E21B 10/36* (2013.01)

(58) Field of Classification Search
USPC ..... 175/265, 273, 281, 381, 384, 284, 286, 175/287, 293, 414
See application file for complete search history.

(56) References Cited

U.S. PATENT DOCUMENTS

| | | | | | |
|---|---|---|---|---|---|
| 1,360,908 | A | * | 11/1920 | Everson | 175/265 |
| 2,344,598 | A | * | 3/1944 | Church | 175/268 |
| 2,485,826 | A | * | 10/1949 | Harinck | 175/286 |
| 4,545,443 | A | | 10/1985 | Wiredal | |
| 4,591,010 | A | * | 5/1986 | Persson | 175/320 |
| 4,842,083 | A | * | 6/1989 | Raney | 175/325.4 |
| 5,139,099 | A | * | 8/1992 | Hayashi et al. | 175/292 |
| 5,361,859 | A | * | 11/1994 | Tibbitts | 175/286 |
| 5,881,827 | A | * | 3/1999 | Ikeda et al. | 175/259 |
| 8,122,977 | B2 | * | 2/2012 | Dewey et al. | 175/61 |

FOREIGN PATENT DOCUMENTS

| | | |
|---|---|---|
| JP | 10-331560 | 12/1998 |
| JP | 2000-104475 | 4/2000 |
| KR | 10-2003-0065052 | 8/2003 |
| KR | 10-2005-0011865 | 1/2005 |
| KR | 10-0718942 | 5/2007 |

OTHER PUBLICATIONS

International Search Report for PCT/KR2008/002805 mailed Oct. 30, 2008.

* cited by examiner

*Primary Examiner* — Shane Bomar
*Assistant Examiner* — Kipp Wallace
(74) *Attorney, Agent, or Firm* — AKC Patents LLC; Aliki K. Collins

(57) ABSTRACT

A hammer bit includes a bit body coupled to a hammer drill, a housing bit disposed to the bit body, at least one wing bit coupled to the housing bit to move up and down slantly, and having a rotating radius that is more increased than an outer surface of the bit body when moving up and is more decreased than the outer surface of the bit body when moving down, and at least one spacer installed to move up and down together with the wing bit and filling up an upper space of the wing bit when the wing bit moves down.

21 Claims, 27 Drawing Sheets

HAMMER BIT

TECHNICAL FIELD

The present invention relates to a hammer bit that is designed to excavate strata.

BACKGROUND ART

In general, hammer bits are used to perform drilling of the ground for the study of the structure and growth of the earth strata. A variety of different hammer bits having different specifications and structures are selected and used depending on a stratum condition or excavation depth.

Excavation methods using the hammer bits are classified, in accordance with whether a reclamation pipe is applied, into a direct excavation method and an indirect excavation method.

In the direct excavation method, the stratum is excavated by the hammer bit mounted on a hammer drill without using the reclamation pipe. The direct excavation method is generally used when the stratum is relatively stable or an excavation hole is not deep enough such that an excavated hole is not collapsed.

In the indirect excavation method, the stratum is excavated in a state where the hammer bit and the hammer drill are inserted into the reclamation pipe. At this point, as the hammer bit excavates the stratum, the reclamation pipe is inserted into an excavated hole together with the hammer bit. The indirect excavation method is generally applied when the stratum is relatively unstable or the excavation hole is deep.

In the indirect excavation method, the hammer bit bores a hole at a portion under the reclamation pipe such that the hole has a lager diameter than the reclamation pipe so that the reclamation pipe can be inserted into the excavated hole. As the excavation depth is increased, a load applied to the hammer bit is increased due to the increase of the pressure applied by a load of the reclamation pipe.

When the hammer bit rotates for the excavation, wing bits are unfolded by being caught by a rock or soil around thereof. At this point, a bit body is provided at an edge thereof with a plurality of folding spaces in which the respective wing bits are folded. The wing bits are coupled in the respective folding spaces by respective hinge shafts to rotate at a predetermined angle.

In addition, when the excavation is finished, the hammer bit rotates in an opposite direction to fold the wing bits such that the hammer bit is down-sized to be smaller than an inner diameter of the reclamation pipe. At this point, since an overall outer diameter of the hammer bit becomes less than the inner diameter of the reclamation pipe, the hammer bit can be withdrawn through the reclamation pipe.

However, sludge such as excavated soil or crushed rocks may be filled in the folding spaces of the bit main body during the excavation. In this case, since the wing bits are not folded even when the hammer bit rotates in the opposite direction after the excavation is finished, the hammer bit cannot be withdrawn.

Further, since the wing bits are coupled to the bit body by the hinge shafts, the loads applied to the wing bits are concentrated on the respective hinge shafts. In addition, as the excavation depth of the hammer bit is increased, the load applied to the hinge shaft of each of the wing bits by the reclamation pipe is increased. Therefore, the chance of damaging the wing bits is increased.

As the chance of damaging the wing bits is increased, the excavation depth of the hammer bit may be limited. In addition, when the hammer bit is damaged during the excavation, the withdrawal of the hammer bit may be abandoned or another location may be excavated.

Further, since the wing bits must be coupled to the bit body by the hinge shafts, the assembling time and cost for the hammer bit may be increased.

DISCLOSURE OF INVENTION

Technical Problem

An aspect of the present invention provides a hammer bit that can prevent a wing bit from not being folded by sludge generated during excavation.

An aspect of the present invention also provides a hammer bit that can prevent a concentrated load is applied to a coupling portion of a wing bit and a bit body.

An aspect of the present invention also provides a hammer bit that can increase an excavation depth, reduce an assembling time, and make it easy to perform an assembling process.

Technical Solution

According to an aspect of the present invention, there is provided a hammer bit including: a bit body coupled to a hammer drill; a housing bit disposed to the bit body; at least one wing bit coupled to the housing bit to move up and down slantly, and having a rotating radius that is more increased than an outer surface of the bit body when moving up and is more decreased than the outer surface of the bit body when moving down; and at least one spacer installed to move up and down together with the wing bit and filling up an upper space of the wing bit when the wing bit moves down.

According to another aspect of the present invention, there is provided a hammer bit including: a bit body coupled to a hammer drill and inserted into a reclamation pipe; a housing bit disposed to the bit body and having a slope portion formed thereon; at least one wing bit having a slope slider formed thereon to correspond to the slope portion of the housing bit, and having a rotating radius that is more increased than an inner diameter of the reclamation pipe when moving up along a slope portion of the housing bit and is more decreased than the inner diameter of the reclamation pipe when moving down along the slope portion of the housing bit; and at least one stopper disposed on the bit body, wherein the stopper catches the wing bit to prevent the wing bit from moving down when the bit body rotates at a predetermined angle.

Advantageous Effects

According to the aspects of the present invention, the hammer bit can prevent the wing bit from not being folded by sludge generated during excavation.

In addition, the hammer bit that can prevent a concentrated load is applied to a coupling portion of the wing bit and the bit body.

Further, the hammer bit can increase an excavation depth, reduce an assembling time, and make it easy to perform an assembling process.

BRIEF DESCRIPTION OF THE DRAWINGS

The above and other aspects, features and other advantages of the present invention will be more clearly understood from the following detailed description taken in conjunction with the accompanying drawings, in which.

BEST MODE FOR CARRYING OUT THE INVENTION

Exemplary embodiments of the present invention will now be described in detail with reference to the accompanying drawings.

Figure 1:
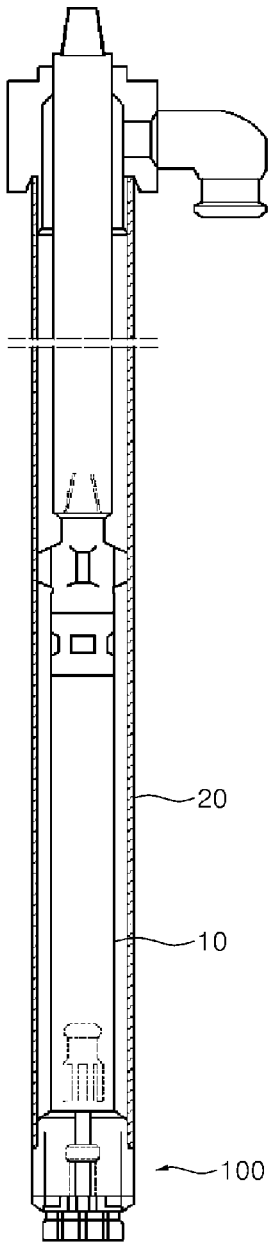
FIG. 1 is a cross-sectional view of a hammer bit according to the present invention.

FIG. 1 is a cross-sectional view of a hammer bit according to the present invention can be applied.

Referring to FIG. 1, a hammer drill 10 is inserted into a reclamation pipe 20. A hammer bit 100 is coupled to a lower portion of the hammer drill 10. The hammer drill 10 rotates to drive the hammer bit 100. The hammer drill 10 supplies air to the hammer bit 100 to vibrate the hammer bit 100. In addition, when the air is supplied to the hammer bit 100, the soil or crushed rocks generated by excavating the stratum are discharged through an upper portion of the reclamation pipe 20. Here, a part of the air supplied from the hammer drill 10 is used to vibrate the hammer bit 100 and the rest is used to discharge the soil and crushed rocks to the ground through the reclamation pipe 20.

The hammer bit 100 bores a hole having a greater diameter than the reclamation pipe 20 as it rotates in a direction. Therefore, as the hammer bit excavates the strata, the reclamation pipe 20 moves downward in the excavated hole. A steel pipe may be used as the reclamation pipe 20.

Figure 2:
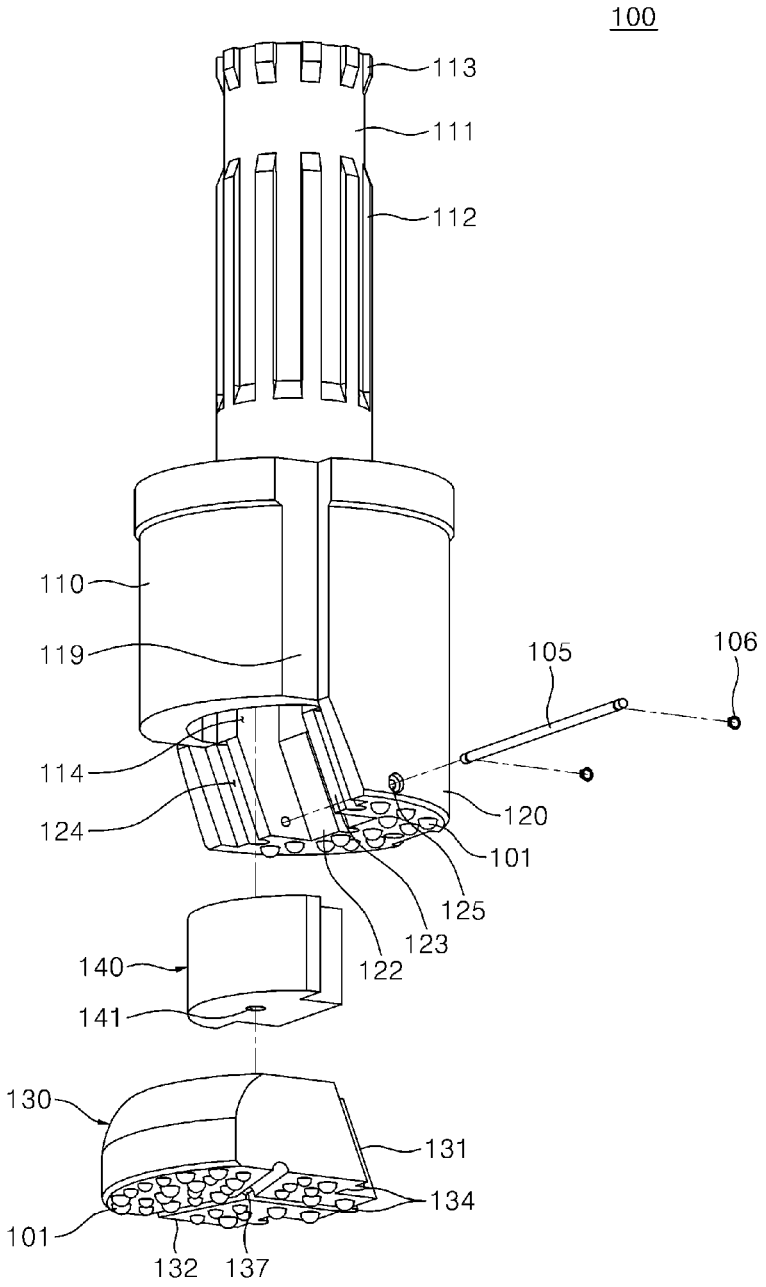
FIG. 2 is an exploded perspective view of a first embodiment of the hammer bit illustrated in FIG. 1.
Figure 3:
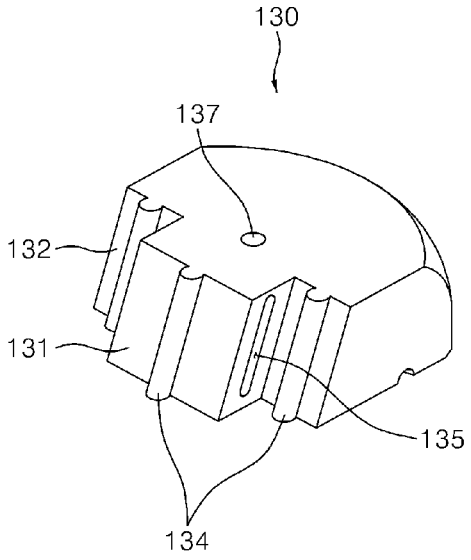
FIG. 3 is a perspective view of a wing bit of the hammer bit of FIG. 2.

FIG. 2 is an exploded perspective view of a first embodiment of the hammer bit illustrated in FIG. 2 and FIG. 3 is a perspective view of a wing bit of the hammer bit of FIG. 2.

Referring to FIGS. 2 and 3, the hammer bit 100 includes a bit body 110, a housing bit 120, and a wing bit 130. A plurality of crushing protrusions 101 may be formed on undersurfaces of the housing bit 120 and wing bit 130. The crushing protrusions 101 may be formed of tungsten carbide or industrial diamond that is excellent in an abrasion-resistance and a heat-resistance.

The bit body 110 includes a coupling portion 111 so that it can be coupled to the hammer drill 10. The coupling portion 111 includes a spline portion 112 and a ring portion 113 for lifting the hammer bit 100 so as to rotate by receiving an external force from the hammer drill 10.

The spline portion 112 may be formed by grooves and protrusions that are alternately arranged in parallel with a length direction of the bit body 110. In addition, the ring portion 113 may be stepped and provided above the spline portion 112.

A housing bit 120 may be disposed under the bit body 110. At this point, the housing bit 120 may be integrally formed with the bit body 110. Alternatively, the housing bit 120 may be separately prepared and coupled to the bit body 110.

A sludge discharge groove 119 may be formed on outer surfaces of the bit body 110 and housing bit 120 so that the air injected from the hammer bit 100 can be discharged to the reclamation pipe 20. The sludge discharge groove 119 may extend in a length direction of the reclamation pipe 20.

A wing bit 130 may be installed on the housing bit 120 to be capable of moving up and down slantly.

For example, a slope portion 122 is formed at a lower portion of the housing bit 120. Slope guides 123 may protrude at both sides of the slope portion 122 of the housing bit 120. The slope portion 122 of the housing bit 120 and the slope guides 123 may be provided with grooves 124 extending in a vertical direction.

A slope slider 131 may be formed on the wing bit 130 to correspond to the slope portion 122 of the housing bit. The slope slider 131 is coupled between the slope guides 123 at both sides of the housing bit 120. Stepped surface portions 132 may be formed at both sides of the slope slider 131 to correspond to the slope guides 123. Guide protrusions 134 may be formed on the slope slider 131 and the stepped surface portion 132 to correspond to the grooves 124 of the housing bit 120.

Elongated slider holes 135 may be formed on the slope slider 131 of the wing bit 130. At this point, the elongated slider holes 135 may slope in parallel to the slope portion 122 of the housing bit 120.

Coupling holes 125 are formed through the slope guides 123 of the housing bit 120 and a clamping pin 105 may be coupled through the coupling holes 125. At this point, the clamping pin 105 is installed through the slider holes 135 to prevent the wing bit 130 from being released from the housing bit 120. Further, snap rings 106 are coupled to opposite sides of the clamping pin 105 to prevent the clamping pin 105 is released through the coupling holes 125 and the slider holes 135. The hammer bit 100 can be easily assembled and disassembly by simply inserting and withdrawing the clamping pin 105 after the wing bit 130 is disposed to correspond to the slope portion 122 of the housing bit 120.

Figure 4:
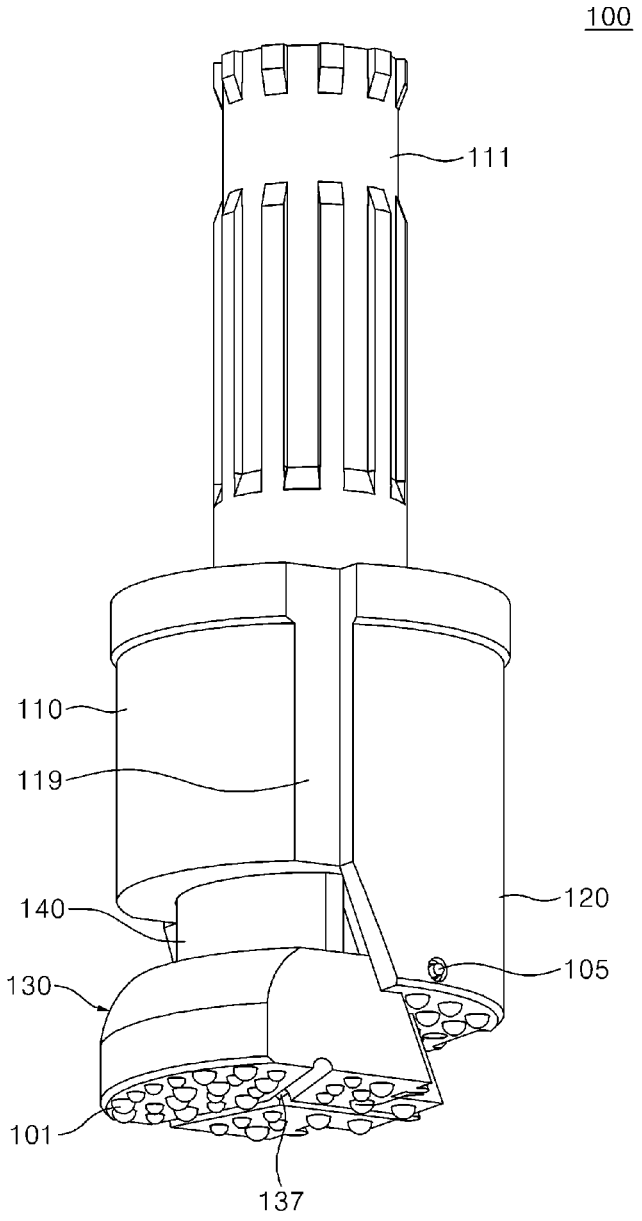
FIG. 4 is a perspective view illustrating a moved down state of the wing bit of the hammer bit of FIG. 3.
Figure 5:
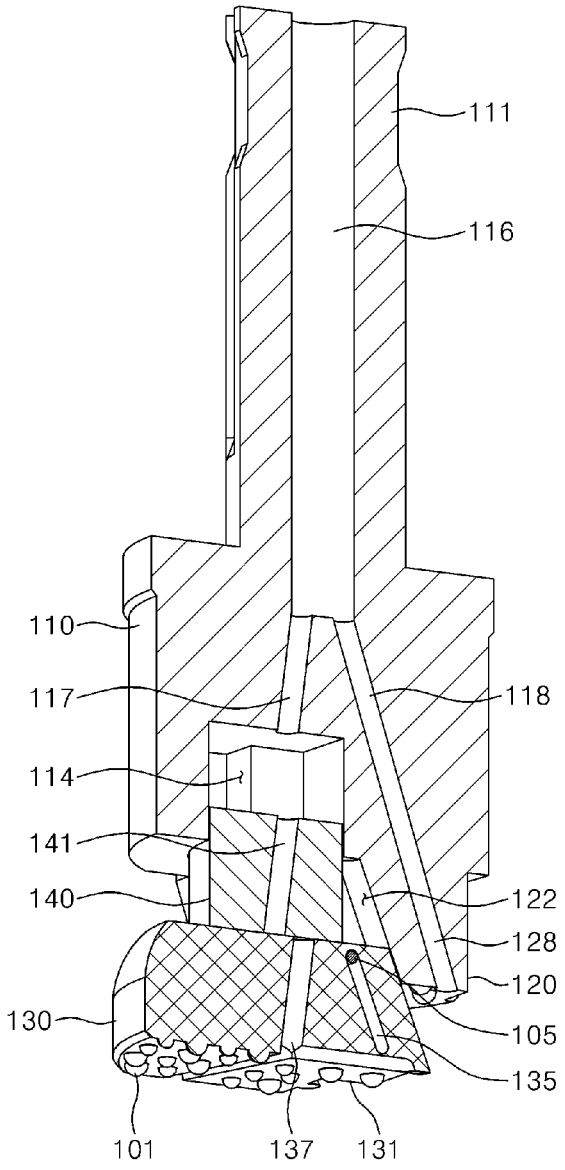
FIG. 5 is a cross-sectioned perspective view illustrating a moved down state of the wing bit of the hammer bit of FIG. 3.

FIG. 4 is a perspective view illustrating a moved down state of the wing bit of the hammer bit of FIG. 3 and FIG. 5 is a cross-sectioned perspective view illustrating a moved down state of the wing bit of the hammer bit of FIG. 3.

Referring to FIGS. 4 and 5, a spacer 140 may be provided above the wing bit 130 to move up and down together with the wing bit 130. The spacer 140 fills up an upper space of the wing bit 130 when the wing bit 130 moves down. At this point, a guide groove 114 may be formed on the bit body 110 to enable the spacer 140 to move up and down.

The spacer 140 may be sized to sufficiently cover an outer side of a top surface of the wing bit 130. Therefore, even when the wing bit 130 moves down, the spacer 140 sufficiently covers the upper space of the wing bit to prevent sludge such as soil or crushed rocks from entering into the upper space of the wing bit 130.

The housing bit 120 and the bit body 110 are provided with air channels 116 along which the air is introduced from the hammer drill 10. One or more connection channels 141 are formed in the spacer 140. The connection channel 141 communicates with the air channel 116 when the spacer moves upward. The wing bit 130 is provided with one or more exhaust channels 137 that communicate with the connection channels 141 of the spacer 140 when the wing bit 130 moves upward.

In the operation of the first embodiment of the hammer bit, referring to FIG. 4 and FIG. 5, the hammer bit 100 is coupled to the hammer drill 10 and inserted in the reclamation pipe 20. The wing bit 130 moves down along the slope portion 122 of the housing bit 120 by the self-gravity. At this point, rotating radii of the housing bit 120 and the wing bit 130 are more decreased than an inner diameter of the reclamation pipe 20 and a rotating radius of the bit body 110.

In addition, since the spacer 140 moves down together with the wing bit 130 by the self-gravity, the upper space of the wing bit 130 is covered by the spacer 140. Therefore, since the entering of the sludge such as the soil and crushed rocks into the upper space of the wing bit 130 can be prevented, the wing bit 130 can be prevented from moving up and down when the wing bit 130 contacts the ground.

Figure 6:
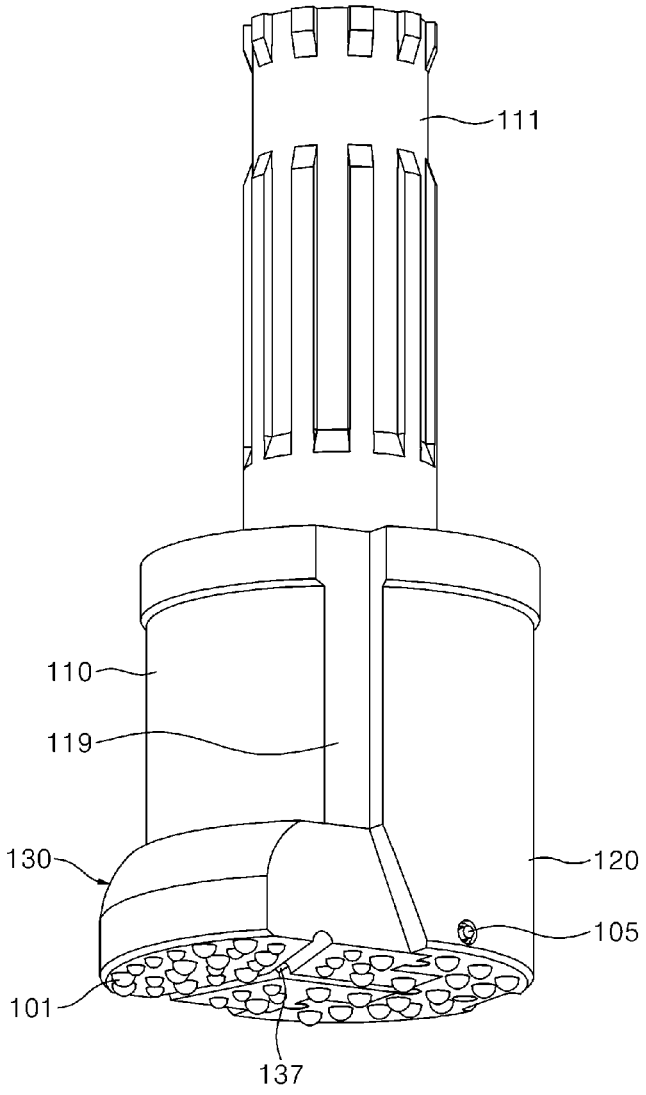
FIG. 6 is a perspective view illustrating a moved up state of the wing bit of the hammer bit of FIG. 3.
Figure 7:
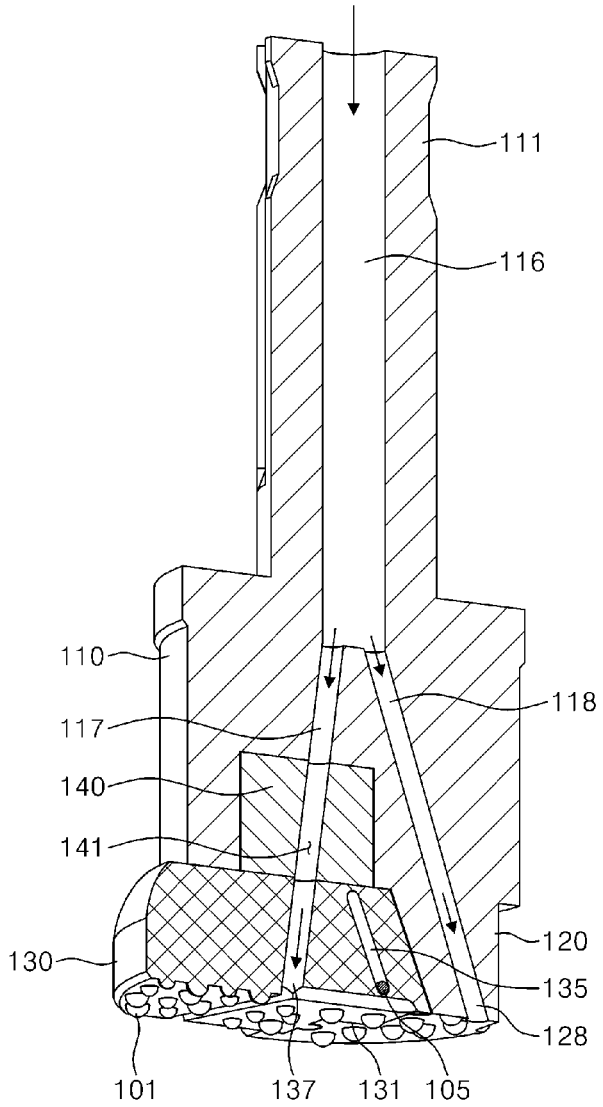
FIG. 7 is a cross-sectioned perspective view illustrating a moved up state of the wing bit of the hammer bit of FIG. 3.

FIG. 6 is a top view illustrating a moved up state of the wing bit of the hammer bit of FIG. 3 and FIG. 7 is a cross-sectioned perspective view illustrating a moved up state of the wing bit of the hammer bit of FIG. 3.

Referring to FIGS. 6 and 7, when the wing bit 130 contacts the ground, the wing bit 130 is pressurized upward and thus the slope slider 131 of the wing bit 130 moves up along the slope portion 122 of the housing bit 120. Therefore, since the wing bit 130 protrudes from the outer surface of the bit body 110, the rotating radius of the wing bit 130 is more increased than the outer surface of the bit body 110 and the rotating radius of the reclamation pipe 20.

When the hammer bit 100 rotates in a state where the wing bit 130 moved up, a hole having a greater diameter than the reclamation pipe is bored by the wing bit 130. Therefore, the reclamation pipe 20 can be inserted into the ground by a depth excavated by the hammer bit 100.

The air supplied from the hammer drill 10 is discharged to the lower portion of the wing bit 130 through the air, connection, and exhaust channels 116, 141, 137, and 128. The air at the lower portion of the wing bit 130 discharges the soil or crushed rocks that are generated by the excavation is discharged to the upper portion of the reclamation pipe 20 through the discharge groove of the bit body 110. Therefore, a phenomenon where the hammer drill 10 receives the resistance by the excavated soil or crushed rocks can be prevented.

In addition, since the slope guide 123 of the housing bit 120 supports the both sides of the wing bit 130 while surface-contacting the both side surfaces of the slider of the wing bit 130, the coupling strength of the housing bit 120 and the wing bit 130 can be enhanced. Therefore, the damage of the wing bit 130 at the hammer bit 100 can be minimized.

Meanwhile, when the excavation is finished or the hammer bit 100 is worn, the hammer bit 100 may be withdrawn.

At this point, when the bit body 110 is lifted, the wing bit 130 moves down by the self-gravity and thus the rotating radius of the wing bit 130 is more decreased than the inner diameter of the reclamation pipe 20. Therefore, the hammer bit 100 can be lifted to be withdrawn.

The following will describe a second embodiment of the hammer bit of the present invention.

Figure 8:
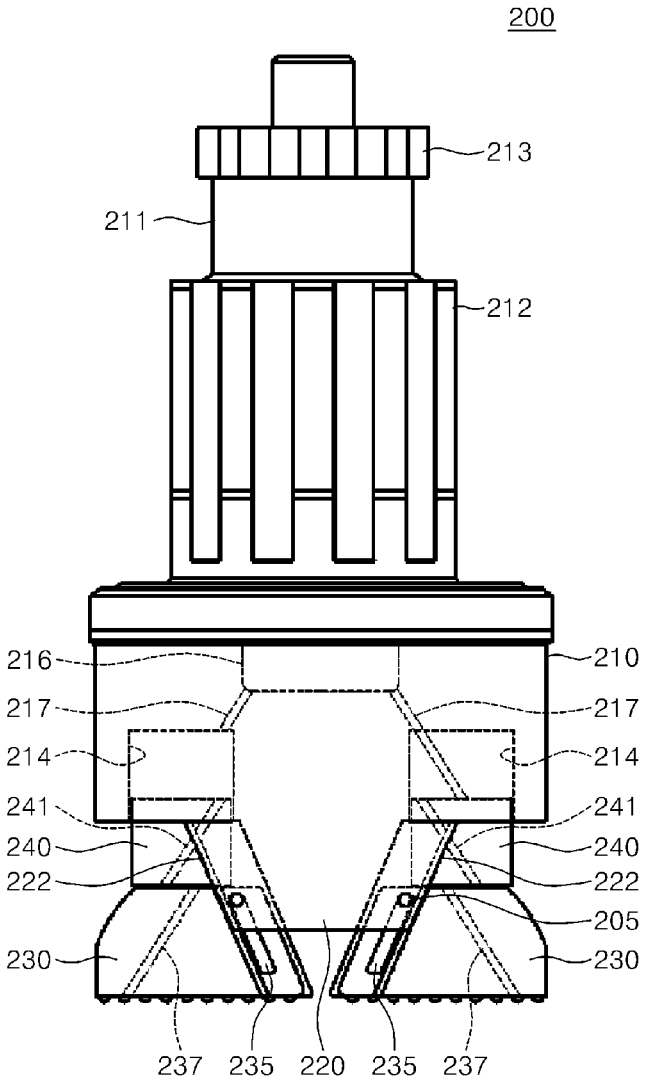
FIG. 8 is an exploded perspective view of a second embodiment of a hammer bit of the present invention.

FIG. 8 is an exploded perspective view of a second embodiment of a hammer bit of the present invention.

Referring to FIG. 8, a hammer bit 200 includes a bit body 210 and a housing bit 220 disposed under the bit body 210. At least two wing bits 230 are installed on the housing bit 220. At this point, at least two slope portions 222 are formed on the housing bit 220 such that the slope portions 222 are converged toward a central portion of the housing bit 220.

The bit body 210 is provided with a guide groove 214 corresponding to the upper portion of each of the wing bits 230. A spacer 240 may be coupled to each of the guide grooves 214 to move up and down together with the wing bit 230. The spacer 240 fills up the upper space of the wing bit 230 as it moves down together with the wing bit 230.

In addition, the spacer 240 is sized to fully cover an outer side of a top surface of the wing bit 230 so as to prevent the sludge from entering into the upper space of the wing bit 230 when the wing bit 230 moves down.

The bit body 210 may be provided with an air channel 216 along which air supplied from the hammer drill 10 (see FIG. 1) flows. The housing bit 220 may be provided with branched channels 217 and 218 corresponding to the spacer 240. The spacer 240 may be provided with one or more connection channels 241 and the wing bit 230 may be provided with one or more exhaust channels 237. At this point, the connection channel 241 and the exhaust channel 237 may communicate with each other when the wing bit 230 moves up. In addition, a plenty of the connection channel 241 and exhaust channel can be formed.

Meanwhile, since the coupling structure of the slope portion 222, spacer 240, and wing bit 230 is substantially identical to the first embodiment, the description thereof will be omitted herein.

Figure 9:
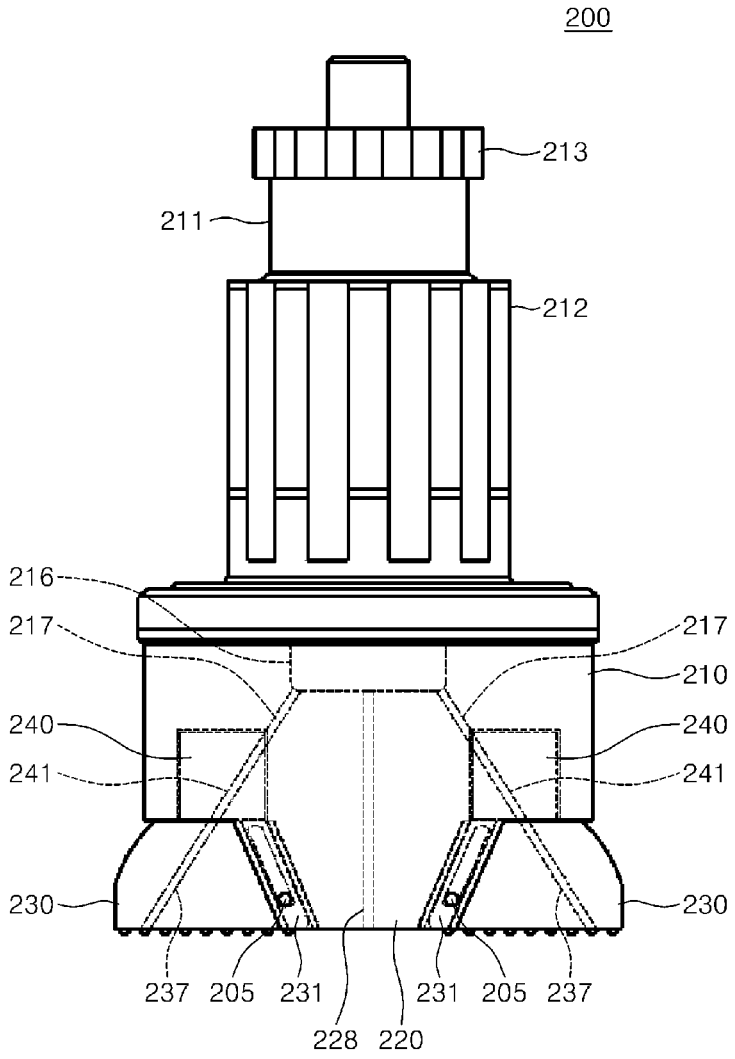
FIG. 9 is a side view illustrating a moved up state of the wing bit of the hammer bit of FIG. 8.

FIG. 9 is a side view illustrating a moved up state of the wing bit of the hammer bit of FIG. 8.

Referring to FIG. 9, the hammer bit 200 moves up when the wing bit 230 contacts the ground, the rotating radius of the wing bit 230 is more increased than the hammer bit 200 and the reclamation pipe 20. Therefore, a wider hole than the reclamation pipe 20 (see FIG. 1) is bored.

At this point, since more than two wing bits 230 are installed on the hammer bit 200, the load applied to each of the wing bits 230 is more reduced than a case where only one wing bit 230 is installed. Therefore, the hammer bit 200 can rotate at a relatively high speed. Further, the damage of each of the wing bits 230 can be minimized.

The following will describe a third embodiment of a hammer bit of the present invention.

Figure 10:
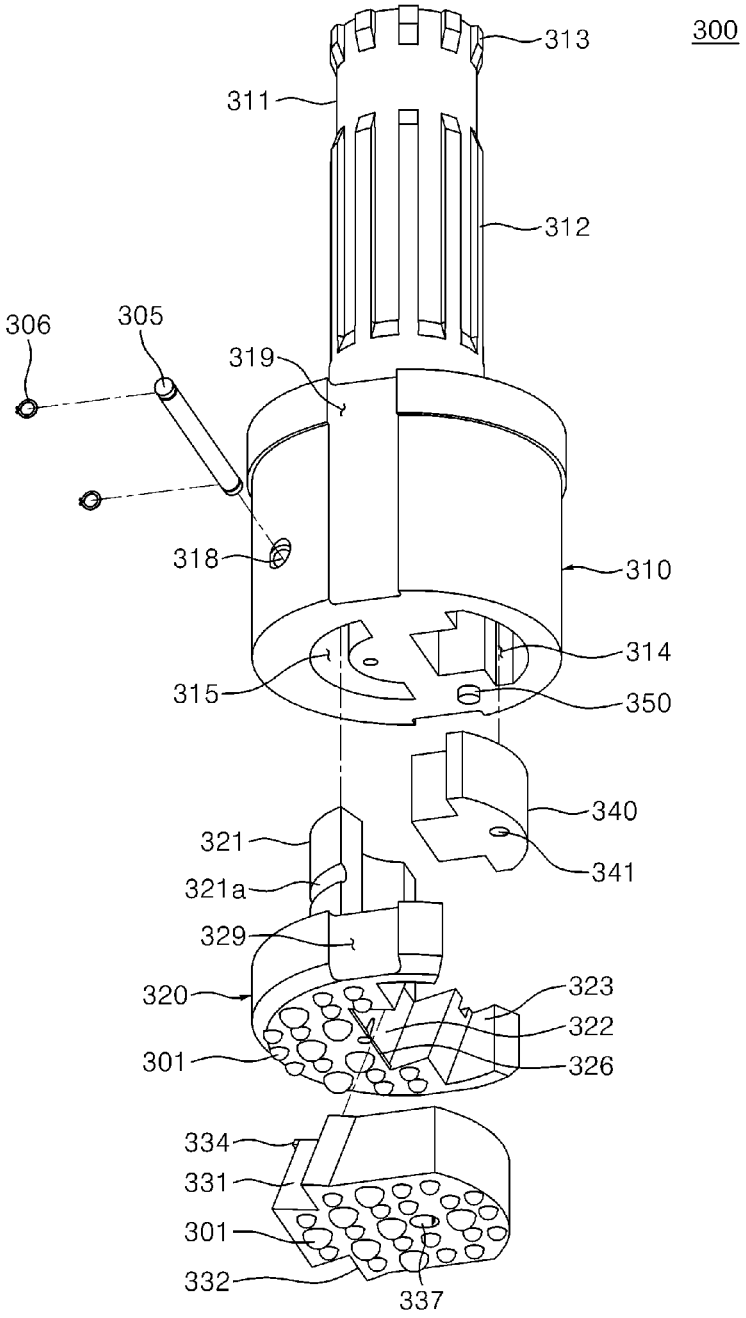
FIG. 10 is an exploded perspective view of a third embodiment of a hammer bit according to the present invention.

FIG. 10 is an exploded perspective view of a third embodiment of a hammer bit according to the present invention.

Referring to FIG. 10, a hammer bit 300 includes a bit body 310, a housing bit 320, and a wing bit 330. A plurality of crushing protrusions 301 may be formed on undersurfaces of the housing bit 320 and wing bit 330. The crushing protrusions 301 may be formed of tungsten carbide or industrial diamond that is excellent in an abrasion-resistance and a heat-resistance.

The bit body 310 includes a coupling portion 311 so that it can be coupled to the hammer drill 10. The coupling portion 311 includes a spline portion 312 and a ring portion 313 for lifting the hammer bit 300 so as to rotate by receiving an external force from the hammer drill 10.

The spline portion 312 may be formed by grooves and protrusions that are alternately arranged in parallel with a length direction of the bit body 310. In addition, the ring portion 313 may be stepped and provided above the spline portion 312.

A sludge discharge groove 319 may be formed on outer surfaces of the bit body 310 and housing bit 320 so that the air injected from the hammer bit 300 can be discharged to the reclamation pipe 20. The sludge discharge groove 319 may extend in a length direction of the reclamation pipe 20.

A housing bit 320 may be coupled to a bottom of the bit body 310 to rotate within a predetermined angle range. For example, an arc-shaped clamping portion 321 may be formed on an upper portion of the housing bit 320 to be inserted into a reception groove 315 of the bit main body 310. At this point, the clamping portion 321 of the housing bit 320 has a smaller arc-shape than the reception groove 315 to provide a marginal gap by which the clamping portion 321 can rotate in the reception groove 315 at a predetermined angle.

The bit body 310 is provided with a coupling hole 318 through the reception groove 315. A marginal gap groove 321*a* may be formed on the clamping portion 321 of the housing bit 320 to correspond to the coupling hole 318 of the reception groove 315. At this point, the marginal gap groove 321*a* may be formed on an outer surface of the clamping portion 321. When a clamping pin 305 is installed through the coupling hole 318 and the marginal gap groove 321*a* in a state where the clamping portion 321 of the housing bit 320 is inserted in the reception groove 315 of the bit body 310, the housing bit 320 rotates at the predetermined angle and is not released from the reception groove 315 of the bit body 310. At this point, snap rings 306 may be installed on both sides of the clamping pin 305 so as to prevent the clamping pin 305 from being removed.

A wing bit 330 may be installed on the housing bit 320 to be capable of moving up and down slantly. For example, a slope portion 322 is formed on the housing bit 320. Slope guides 323 may protrude at both sides of the slope portion 322 of the housing bit 320. At this point, the slope portion 322 slopes in a vertical direction. In addition, the slope guides 323 slope in the vertical direction in parallel to the slope portion 322. The slope guides 323 may be formed in a wedge shape protruding inward.

A slope slider 331 may be formed on the wing bit 330 to correspond to the slope portion 322 of the housing bit. The slope slider 331 is coupled between the slope guides 323 at both sides of the housing bit 320. Stepped surface portions 332 may be formed at both sides of the slope slider 331 to correspond to the slope guides 323. Both side surfaces of the slope slider 331 slopes outward. Therefore, when the slope slider 331 of the wing bit 330 is fitted to the slope portion 322 of the housing bit 320, the withdrawal of the wing bit 330 to an outer side of the housing bit 320 can be prevented by a catching step 334 of the wing bit 330 and a catching step 326 of the housing bit 320.

The catching step 326 may be formed on a lower portion of the slope portion 322 of the housing bit 320 and the catching step 334 may be formed on a lower portion of the slope slider 331 of the wing bit 330 so that the wing bit 330 is caught by the catching step 326 of the housing bit 320 when moving down.

Since the bit body 310 and the housing bit 320 are separately formed, the wing bit 330 is coupled from the housing bit 320, after which the clamping portion 321 of the housing bit 320 may be fixed in the reception groove 315 of the bit body 310. Therefore, it is relatively easy to assemble the hammer bit 300 as compared with a structure in which the bit body 310 is integrally formed with the housing bit 320 and coupled from a lower side of the housing bit 320. Particularly, even when the hammer bit 300 increases its weight, the hammer bit 300 can be easily assembled.

Figure 11:
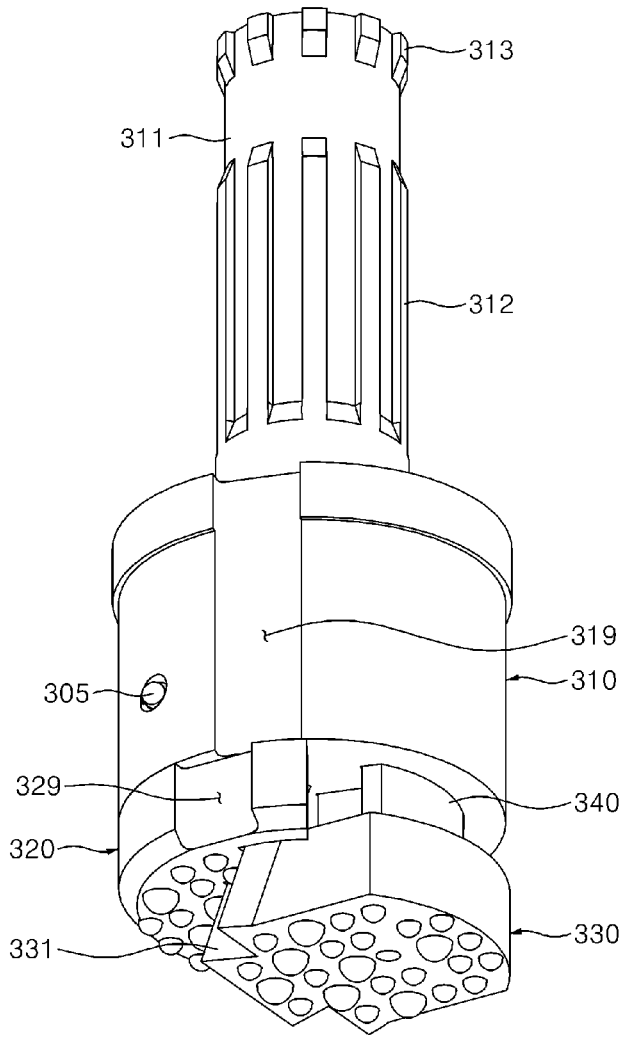
FIG. 11 is a perspective view illustrating a moved down state of the wing bit of the hammer bit of FIG. 10.
Figure 12:
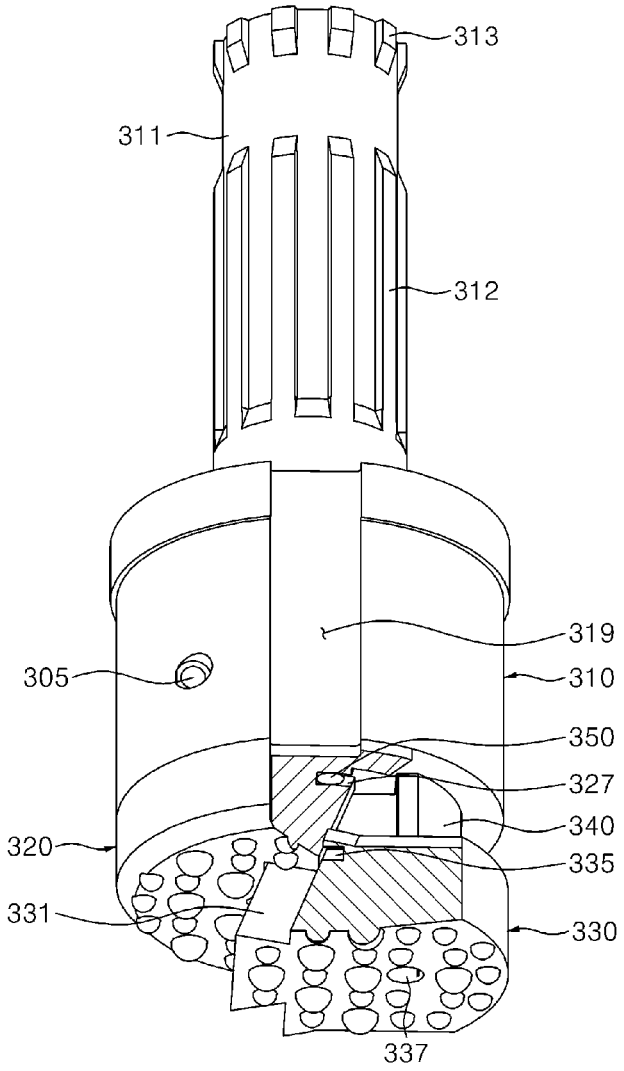
FIG. 12 is a perspective view illustrating a position of a stopper in the moved down state of the wing bit of the hammer bit of FIG. 11.
Figure 13:
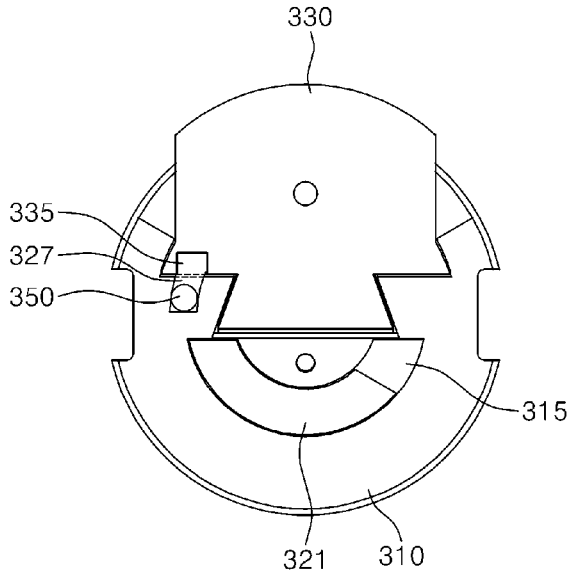
FIG. 13 is a bottom view of the position of the stopper in the moved down state of the wing bit of the hammer bit of FIG. 11.

FIG. 11 is a perspective view illustrating a moved down state of the wing bit of the hammer bit of FIG. 10, FIG. 12 is a perspective view illustrating a position of a stopper in the moved down state of the wing bit of the hammer bit of FIG. 11, and FIG. 13 is a view of the position of the stopper in the moved down state of the wing bit of the hammer bit of FIG. 11.

Referring to FIGS. 11 to 13, a spacer 340 may be provided above the wing bit 330 to move up and down together with the wing bit 330. The spacer 340 fills up an upper space of the wing bit 330 when the wing bit 330 moves down. At this point, a guide groove 314 may be formed on the bit body 310 to enable the spacer 340 to move up and down.

The spacer 340 may be sized to sufficiently cover an outer side of a top surface of the wing bit 330. Therefore, even when the wing bit 330 moves down, the spacer 340 sufficiently covers the upper space of the wing bit to prevent sludge such as soil or crushed rocks from entering into the upper space of the wing bit 330.

A stopper 350 may be formed on a lower portion of the bit body 310 to catch the wing bit 330 when the bit body 310 rotates at the predetermined angle, thereby preventing the wing bit 330 from moving down. A hanging groove 335 in which the stopper 350 is located when the bit body 310 rotates at the predetermined angle may be formed on an upper portion of the wing bit 330. Further, a shelter groove 327 connected to the hanging groove 335 may be formed on the housing bit 320. At this point, the hanging groove 335 and shelter groove 327 of the wing bit 330 may be formed in an arc-shape so that the stopper 350 moves along the hanging groove 335 and the shelter groove 327 of the wing bit 330 and the shelter groove 327 of the housing bit 330 when the housing bit 320 rotates.

Therefore, when the stopper 350 moves to the hanging groove 335 of the wing bit 330 by the rotation of the housing bit 320 in a direction at the predetermined angle, the wing bit 330, which intends to move down in a slope direction by the self-gravity, cannot move down as the stopper 350 is hung on the hanging groove 335. For example, although the wing bit 330 intends to move down along a slope of 45 degree, the wing bit 330 cannot move down because the stopper 350 is hung on the hanging groove 335.

When the stopper 350 moves to the shelter groove 327 of the housing bit 320 by the rotation of the housing bit 320 in an opposite direction at the predetermined angle, the wing bit 330 can move down by the self-gravity because the wing bit 330 is not caught by the stopper 350.

Figure 14:
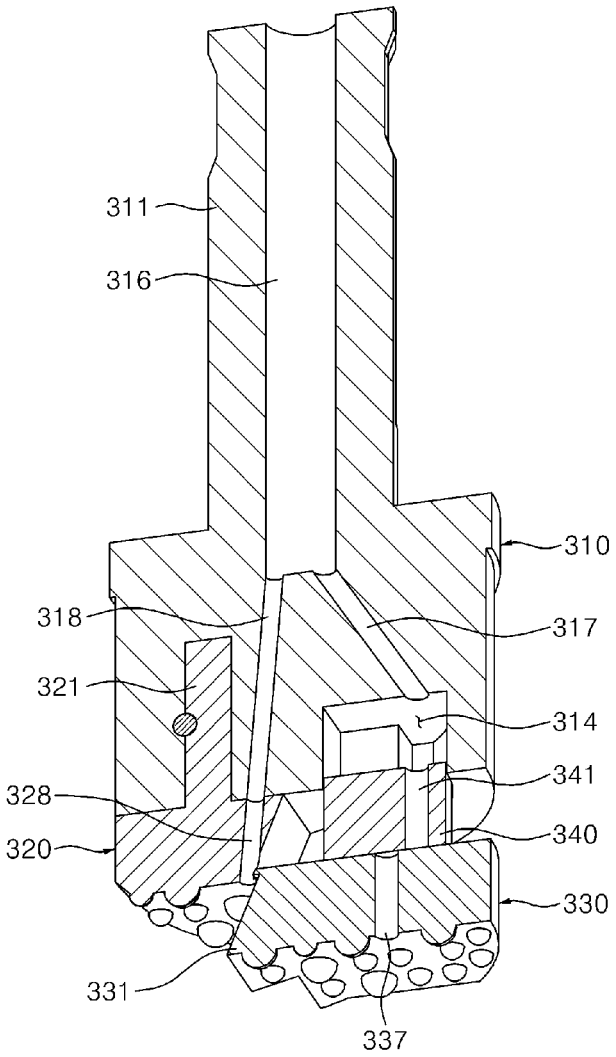
FIG. 14 is a cross-sectioned perspective view illustrating a moved down state of the wing bit of the hammer bit of FIG. 11.

FIG. 14 is a cross-sectioned perspective view illustrating a moved down state of the wing bit of the hammer bit of FIG. 11.

Referring to FIG. 14, the bit body 310 may be provided with an air channel 316 along which air supplied from the hammer drill 10 (see FIG. 1) flows. The air channel 316 may include branched channels 317 and 318 that are branched off to correspond to the spacer 340 or/and the housing bit 320. At this point, one or more branched channels 317 and 318 may correspond to the spacer 340 or/and the housing bit 320. The housing bit 320 may be provided with one or more exhaust channels 328 connected to the branched channels 317 and 318 of the bit body 310. At this point, the number of the exhaust channels 328 may be same as the number of the branched channels 318 corresponding to the housing bit 320.

In addition, the spacer 340 is provided with one or more connection channels 341 corresponding to the branched channels 317 of the bit body 310. At this point, the number of the connection channels 341 of the spacer 340 may be same as the number of the branched channels 317. The wing bit 330 may be provided with an exhaust channel 337 that communicates with the connection channel 341 of the spacer 340 when the wing bit 330 moves up.

Therefore, the air supplied from the hammer drill 10 may be exhausted through the housing bit 320 or/and the lower side of the wing bit 330.

In the operation of the third embodiment of the hammer bit 300 of the present invention, Referring to FIG. 11 to FIG. 14, the hammer bit 300 is coupled to the hammer drill 10 and inserted in the reclamation pipe 20. The wing bit 330 moves down along the slope portion 322 of the housing bit 320 by the self-gravity. At this point, rotating radii of the housing bit 320 and the wing bit 330 are more decreased than an inner diameter of the reclamation pipe 20 and a rotating radius of the bit body 310.

In addition, since the spacer 340 moves down together with the wing bit 330 by the self-gravity, the upper space of the wing bit 330 is covered by the spacer 340. Therefore, since the entering of the sludge such as the soil and crushed rocks into the upper space of the wing bit 330 can be prevented, the wing bit 330 can reliably move upward when the wing bit 330 contacts the ground.

Figure 15:
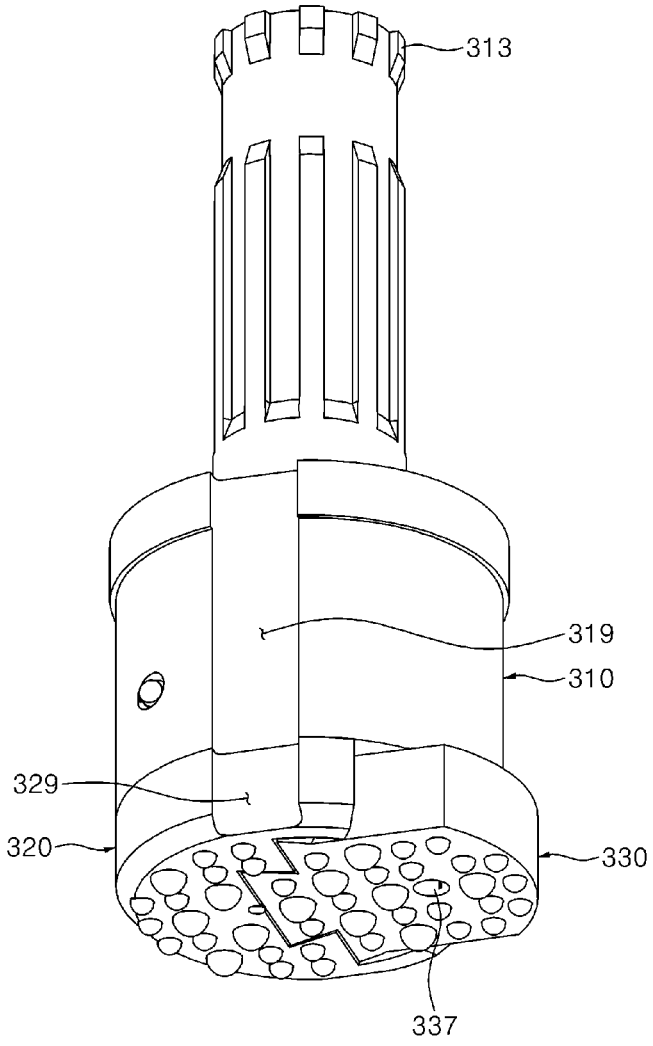
FIG. 15 is a perspective view illustrating a moved up state of the wing bit of the hammer bit of FIG. 10.
Figure 16:
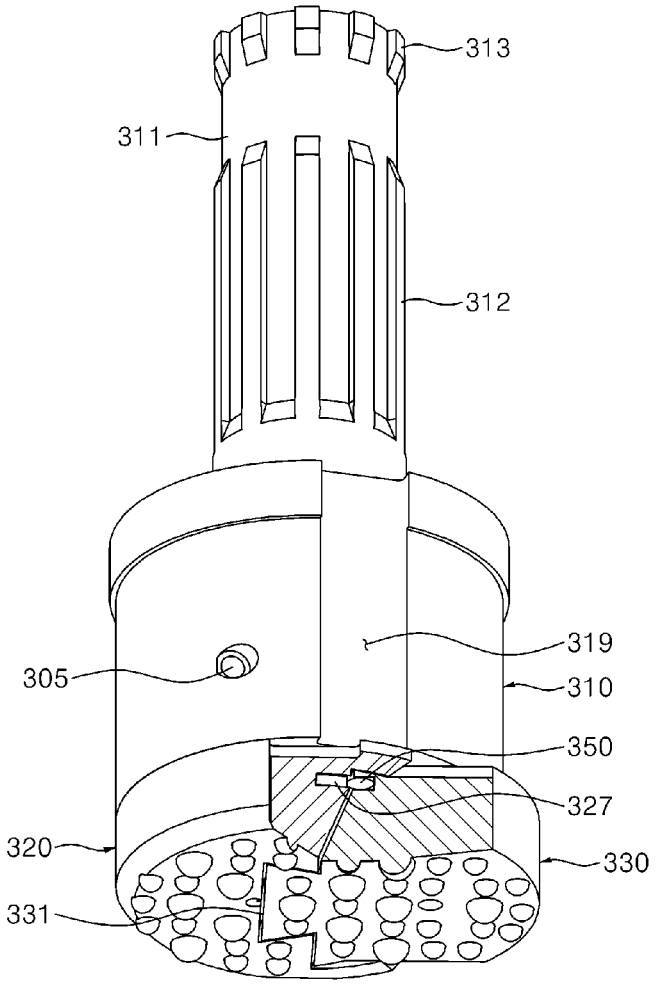
FIG. 16 is a perspective view illustrating a position of a stopper in the moved up state of the wing bit of the hammer bit of FIG. 15.
Figure 17:
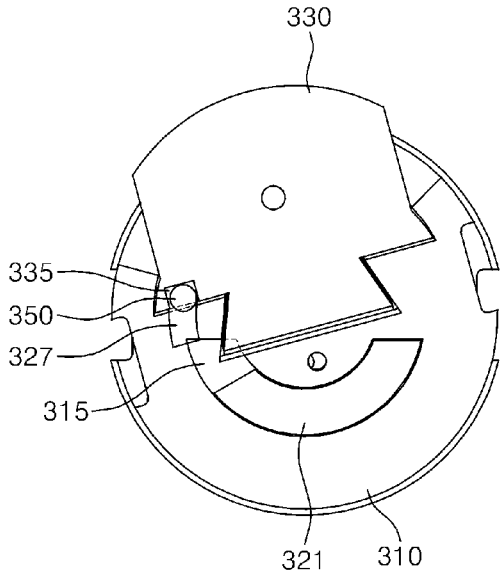
FIG. 17 is a view of the position of the stopper in the moved up state of the wing bit of the hammer bit of FIG. 15.
Figure 18:
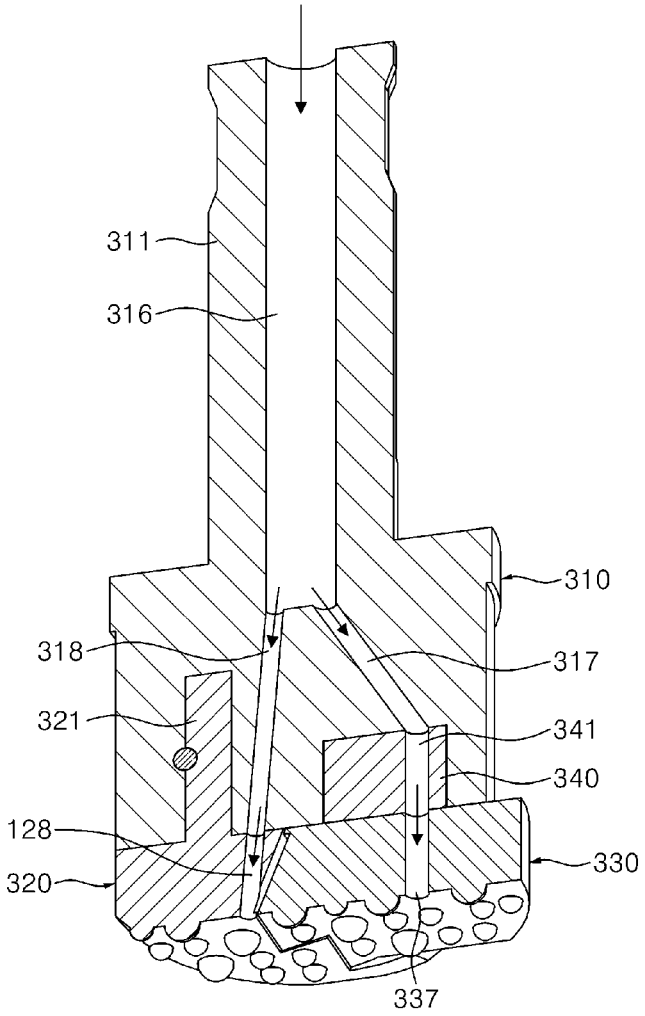
FIG. 18 is a cross-sectioned perspective view illustrating a moved up state of the wing bit of the hammer bit of FIG. 15.

FIG. 15 is a perspective view illustrating a moved up state of the wing bit of the hammer bit of FIG. 10, FIG. 16 is a perspective view illustrating a position of a stopper in the moved up state of the wing bit of the hammer bit of FIG. 15, FIG. 17 is a view of the position of the stopper in the moved up state of the wing bit of the hammer bit of FIG. 15, and FIG. 18 is a cross-sectioned perspective view illustrating a moved up state of the wing bit of the hammer bit of FIG. 15.

Referring to FIGS. 15 to 18, when the wing bit 330 contacts the ground, the wing bit 330 is pressurized and thus the wing bit 330 and the spacer 340 move upward. At this point, under-surfaces of the housing bit 320 and the wing bit 330 are located at an almost same plane.

When the hammer bit 300 rotates in a direction, the bit body 310 rotates in a direction at a predetermined angle while the housing bit 320 and the wing bit 330 do not rotate. At this point, the stopper 350 of the bit main body 310 moves to the hanging groove 335 of the wing bit 330 and thus the wing bit 330 is caught by the stopper 350 not to move down but be stably fixed. Therefore, the fluctuation of the wing bit 330 in a vertical direction due to an irregular excavating surface can be prevented during the housing bit 320 and the wing bit 330 rotate for the excavation. In addition, since the wing bit 330 is stably fixed during the excavation of the hammer drill 10, the damage of the wing bit 330 can be minimized.

In addition, since the wing bit 330 protrudes outward, the rotating radius of the wing bit 330 is more increased than outer diameters of the bit body 310 and reclamation pipe 20.

Further, the exhaust channel 328 of the housing bit 230 is connected to the branched channel 318 of the bit body 310 and the exhaust channel 337 of the wing bit 330 is connected to the branched channel 317 of the bit body 310 and to the connection channel 341 of the spacer 340. Therefore, even when the housing bit 320 and the wing bit 330 rotate, the air can be exhausted through the housing bit 320 and the wing bit 330.

Since the stopper 350 can prevent the wing bit 330 from fluctuating in the vertical direction, the air can be stably supplied to the exhaust channel 337 of the wing bit 330. Therefore, the excavated soil and crushed rocks can be stably discharged to an external side through the reclamation pipe 20.

When the hammer bit 300 rotates in the moved up state of the wing bit 330, a greater hole than a diameter of the reclamation pipe 20 is bored by the wing bit 330. Therefore, the reclamation pipe 20 can be inserted into the ground by a depth excavated by the hammer bit 300.

The air exhausted from the housing bit 320 and the wing bit 330 is exhausted together with the excavated soil or crushed rocks to the upper side of the reclamation pipe 20 through the discharge groove of the bit body 310. Therefore, the hammer drill 10 can keep boring the hole without receiving the resistance generated by the excavated soil or crushed rocks.

Further, since the slope guide 323 of the housing bit 320 supports the both sides of the wing bit 330 while surface-contacting the both side surfaces of the slider of the wing bit 330, the coupling strength of the housing bit 320 and the wing bit 330 can be enhanced. Therefore, the damage of the wing bit 330 at the hammer bit 300 can be minimized.

Meanwhile, when the excavation is finished or the hammer bit 300 is worn, the hammer bit 300 may be lifted.

Referring to FIGS. 11 to 14, when the hammer bit 300 rotates at a predetermined angle in a direction opposite to the direction in which the hammer bit rotates during the excavation, the bit body 310 rotates at a predetermined angle in an opposite direction while the housing bit 320 and the wing bit 330 do not rotate. At this point, since the stopper 350 of the bit main body 310 moves from the hanging groove 335 of the wing bit 330 to the shelter groove 327 of the housing bit 320, the restriction of the wing bit 330 is released.

In addition, when the bit body 310 is lifted, the wing bit 330 moves down by the self-gravity and thus the rotating radii of the housing bit 320 and wing bit 330 are more decreased than the inner diameter of the reclamation pipe 20. Therefore, the hammer bit 300 can be withdrawn by being lifted.

The following will describe a fourth embodiment of a hammer bit of the present invention.

Figure 19:
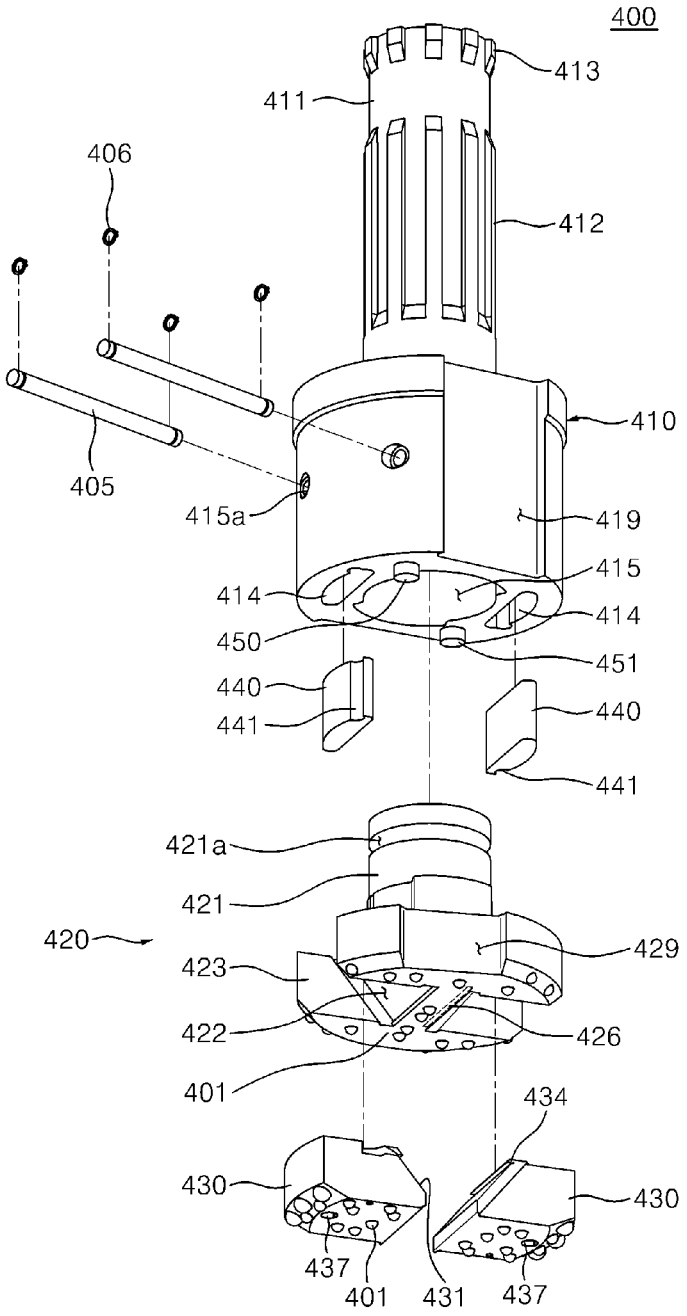
FIG. 19 is an exploded perspective view of a fourth embodiment of a hammer bit according to the present invention.

FIG. 19 is an exploded perspective view of a fourth embodiment of a hammer bit according to the present invention.

Referring to FIG. 19, a hammer bit 400 includes a bit body 410, a housing bit 420, and at least two wing bits 430. A plurality of crushing protrusions 401 may be formed on undersurfaces of the housing bit 420 and wing bit 430. The crushing protrusions 401 may be formed of tungsten carbide or industrial diamond that is excellent in an abrasion-resistance and a heat-resistance.

The bit body 410 includes a coupling portion 411 so that it can be coupled to the hammer drill 10. The coupling portion 411 includes a spline portion 412 and a ring portion 413 for lifting the hammer bit 400 so as to rotate by receiving an external force from the hammer drill 10.

The spline portion 412 may be formed by grooves and protrusions that are alternately arranged in parallel with a length direction of the bit body 410. In addition, the ring portion 413 may be stepped and provided above the spline portion 412.

A sludge discharge groove 419 may be formed on outer surfaces of the bit body 410 and housing bit 420 so that the air injected from the hammer bit 400 can be discharged to the reclamation pipe 20. The sludge discharge groove 419 may extend in a length direction of the reclamation pipe 20.

A housing bit 420 may be coupled to the bit body 410 to rotate within a pre-determined angle range.

For example, a cylindrical reception groove is formed on a lower portion of the bit body 410. A cylindrical or circular column-shaped clamping portion 421 may be formed the upper portion of the housing bit 420 to be capable of being inserted into the reception groove of the bit body 410. At this point, since the clamping portion is formed in a cylindrical shape or a circular column shape, the generation of a concentrated load on a portion of the clamping portion 421 can be prevented.

The bit body 410 is provided with a coupling hole 415*a* through the reception groove. A marginal gap groove 421*a* may be formed on the clamping portion 421 of the housing bit 420 to correspond to the coupling hole 415*a* of the reception groove 415. At this point, the marginal gap groove 421*a* may be provided in the form of a ring shape along an outer circumference of the clamping portion 421 of the marginal gap groove 421*a*.

When a clamping pin 405 is installed through the coupling hole 415*a* and the marginal gap groove 421*a* in a state where the clamping portion 421 of the housing bit 420 is inserted in the reception groove of the bit body 410, the housing bit 420 rotates at the predetermined angle and is not released from the reception groove 415 of the bit body 410. At this point, snap rings 406 may be installed on both sides of the clamping pin 405 so as to prevent the clamping pin 405 from being removed.

A wing bit 430 may be installed on the housing bit 420 to be capable of moving up and down slantly. For example, at least two slope portions 422 are formed on both sides of the housing bit 420 at locations of 180 degree. Slope guides 423 may protrude at both sides of each of the slope portions 422. At this point, the slope portions 422 slopes to be converged toward a central portion of each of the slope portions 422. When three slope portions 422 are formed on the housing bit 420, the slope portions 422 may be formed at locations of about 120 degree.

The slope guide 423 may be provided with a guide groove in parallel to the slope portion 422. Guide protrusions (not shown) may be formed on both sides of each of the wing bits 430 to be capable of being slidably coupled to the guide grooves of the slope portions 422. The guide protrusions of the wing bit 430 functions to prevent the wing bit 430 from being removed to an external side.

A slope slider 431 may be formed on the wing bit 430 to correspond to the slope portion 422 of the housing bit. The slope slider 431 is coupled between the slope guides 423 at both sides of the housing bit 420. At this point, the slope slider 431 may be provided in the form of a slope surface.

A catching step 426 may be formed on a lower portion of each of the slop portions 422 of the housing bit 420 and a catching step 434 may be formed on a lower portion of the slope slider 431 of the wing bit 430 so that the wing bit 430 is caught by the catching step 426 of the housing bit 420 when moving down.

Since the bit body 410 and the housing bit 420 are separately formed, the wing bit 430 is coupled from the housing bit 420, after which the clamping portion 421 of the housing bit 420 may be fixed in the reception groove 415 of the bit body 410. Therefore, it is relatively easy to assemble the hammer bit 400 as compared with a structure in which the bit body 410 is integrally formed with the housing bit 420 and coupled from a lower side of the housing bit 420. Particularly, as even when the hammer bit 400 is heavy, the hammer bit 400 can be easily assembled.

Figure 20:
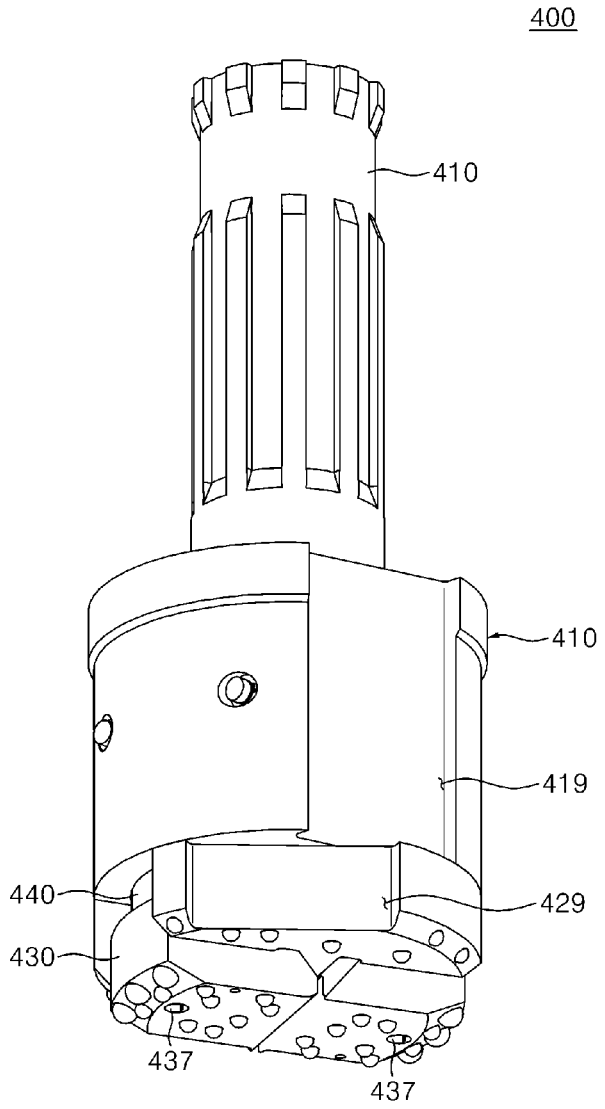
FIG. 20 is a perspective view illustrating a moved down state of the wing bit of the hammer bit of FIG. 19.
Figure 21:
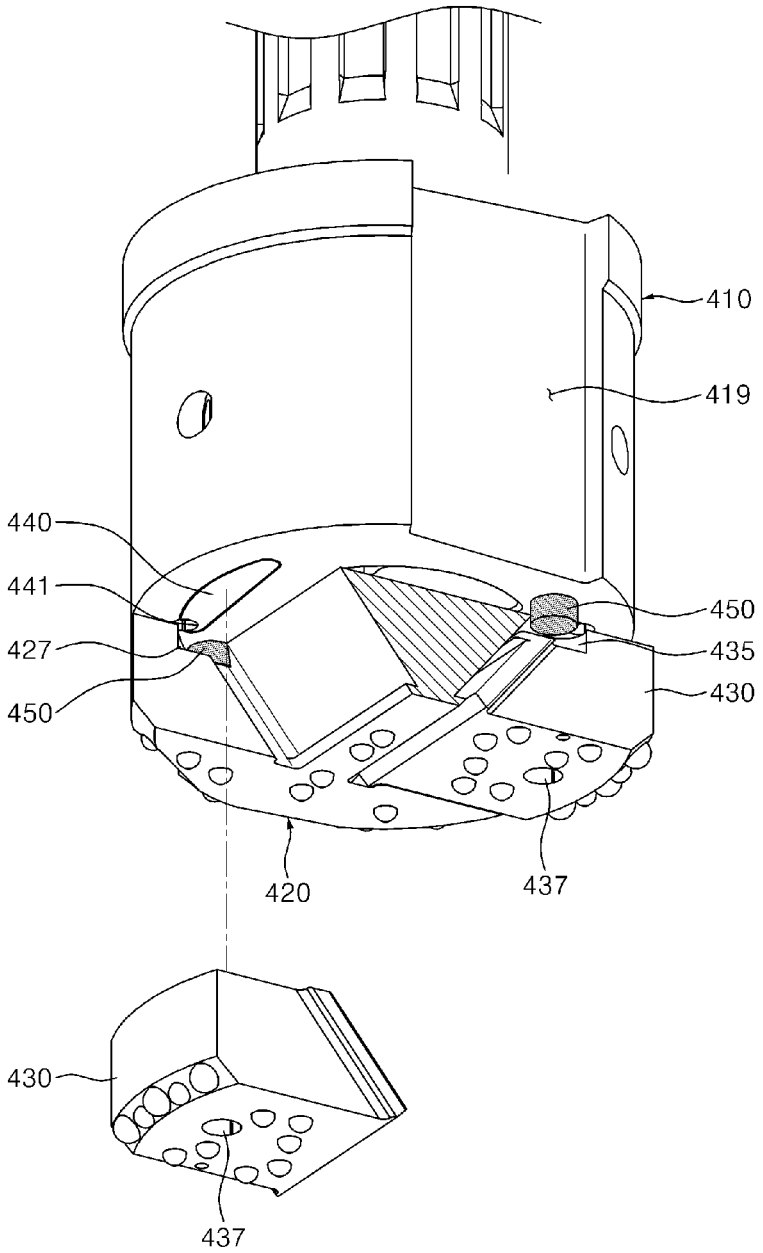
FIG. 21 is a perspective view illustrating a position of a stopper in the moved down state of the wing bit of the hammer bit of FIG. 20.
Figure 22:
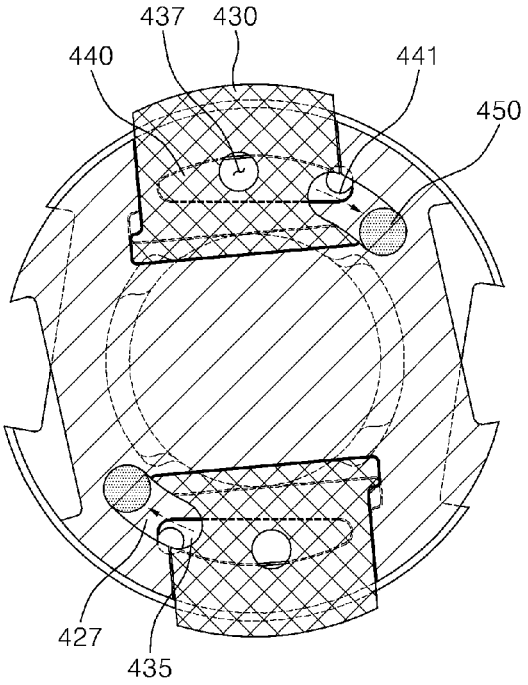
FIG. 22 is a cross-sectioned perspective view of the position of the stopper in the moved down state of the wing bit of the hammer bit of FIG. 20.

FIG. 20 is a perspective view illustrating a moved down state of the wing bit of the hammer bit of FIG. 19, FIG. 21 is a perspective view illustrating a position of a stopper in the moved down state of the wing bit of the hammer bit of FIG. 20, and FIG. 22 is a view of the position of the stopper in the moved down state of the wing bit of the hammer bit of FIG. 20.

Referring to FIGS. 20 to 22, spacers 440 may be provided above the wing bit 430 to move up and down together with the wing bit 430. The spacers 440 fill up an upper space of the wing bit 430 when the wing bit 430 moves down. At this point, guide grooves 414 may be formed on the bit body 410 to enable the respective spacer 440 to move up and down.

Each of the spacers 440 may be sized to sufficiently cover an outer side of a top surface of the wing bit 430. Therefore, even when the wing bit 430 moves down, the spacer 440 sufficiently covers the upper space of the wing bit to prevent sludge such as soil or crushed rocks from entering into the upper space of the wing bit 430.

The wing bits 430 may be formed with a same size or different sizes. When the wing bits are formed with different sizes, each of the spacers 440 may have a size corresponding to the corresponding wing bit 430 so that it can cover a top surface of the corresponding wing bit 430.

One or more stoppers 450 may be formed on a lower portion of the bit body 410 to catch the wing bits 430 when the bit body 410 rotates at the predetermined angle, thereby preventing the wing bit 430 from moving down. At this point, the number of the stoppers 450 may be same as the number of the wing bits 430. The stopper 450 may be integrally formed on or coupled to the undersurface of the bit body 410.

Hanging grooves 435 in which the stoppers 450 are located when the bit body 410 rotates at the predetermined angle may be formed on upper portions of the respective housing bits 420. Further, shelter grooves 427 connected to the respective hanging groove 435 may be formed on the respective housing bits 320. At this point, the hanging grooves 435 and shelter grooves 427 of the wing bits 430 may be formed in an arc shape so that the stoppers 450 move along the hanging grooves 435 of the wing bits 430 and the shelter groove 427 of the housing bit 420 when the bit body 410 rotates.

Therefore, when the stopper 450 moves to the corresponding hanging groove 435 of the wing bit 430 by the rotation of the bit body 410 in a direction at the predetermined angle, the wing bit 430, which intends to move down in a slope direction by the self-gravity, cannot move down as the stopper 450 is hung on the corresponding hanging groove 435.

When the stopper 450 moves to the corresponding shelter groove 427 of the housing bit 420 by the rotation of the housing bit 420 in an opposite direction at the pre-determined angle, the wing bit 430 can move down by the self-gravity because the wing bit 430 is not caught by the corresponding stopper 450.

The sludge discharge groove 419 of the housing bit 420 may be misaligned with the sludge discharge groove 419 when the wing bit 430 moves down by the rotation of the bit body 410 in the opposite direction at the predetermined angle. In addition, the sludge discharge groove 419 of the housing bit 420 may be connected to the sludge discharge groove 419 of the bit body 410 when the wing bit 430 moves up by the rotation of the bit body 410 in the forward direction 410.

Figure 23:
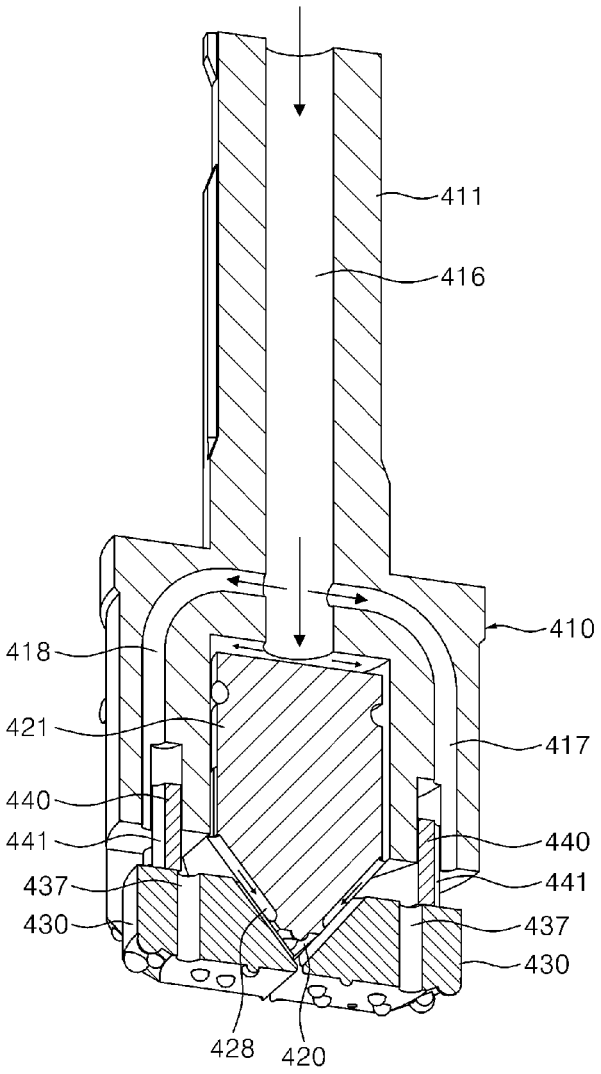
FIG. 23 is a cross-sectioned perspective view illustrating a moved down state of the wing bit of the hammer bit of FIG. 20.

FIG. 23 is a cross-sectioned perspective view illustrating a moved down state of the wing bit of the hammer bit of FIG. 20.

Referring to FIG. 23, the bit body 410 may be provided with an air channel 416 along which air supplied from the hammer drill 10 flows. The air channel 416 may include branched channels 417 and 418 that are branched off to correspond to the spacer 440 or/and the housing bit 420. At this point, one or more branched channels 417 and 418 may correspond to the spacer 440 or/and the housing bit 420.

The housing bit 420 may be provided with one or more exhaust channels 428 connected to the branched channels 418 of the bit body 410. At this point, the number of the exhaust channels 428 may be same as the number of the branched channels 418 corresponding to the housing bit 420.

In addition, the spacer 440 is provided with one or more connection channels 441 corresponding to the branched channels 417 of the bit body 410. At this point, the number of the connection channels 441 of the spacer 440 may be same as the number of the branched channels 417. The wing bit 430 may be provided with an exhaust channel 437 that communicates with the connection channel 441 of the spacer 440 when the wing bit 430 moves up. Therefore, the air supplied from the hammer drill 10 may be exhausted through the housing bit 420 or/and the lower side of the wing bit 430.

In the operation of the fourth embodiment of the hammer bit 400 of the present invention, the hammer bit 400 is coupled to the hammer drill 10 and inserted in the reclamation pipe 20. The wing bits 430 move down along the slope portions 422 of the housing bit 420 by the self-gravity. At this point, a rotating radius of each of the wing bits 430 is more decreased than an inner diameter of the reclamation pipe 20 and a rotating radius of the bit body 410. At this point, the stopper 450 is located in the shelter groove 427 of the housing bit 420.

In addition, since each of the spacers 440 moves down together with the corresponding wing bit 430 by the self-gravity, the upper space of each of the wing bits 430 is covered by the spacer 440. Therefore, since the entering of the sludge such as the soil and crushed rocks into the upper space of each of the wing bits 430 can be prevented, the wing bits 430 can reliably move upward when the wing bits 430 contact the ground.

Figure 24:
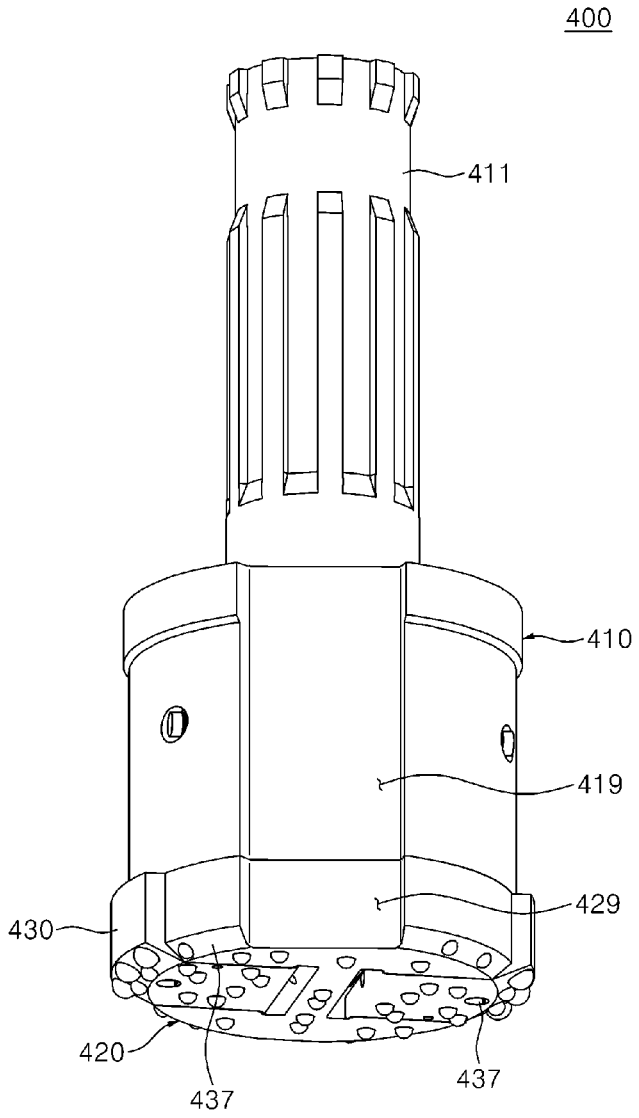
FIG. 24 is a perspective view illustrating a moved up state of the wing bit of the hammer bit of FIG. 19.
Figure 25:
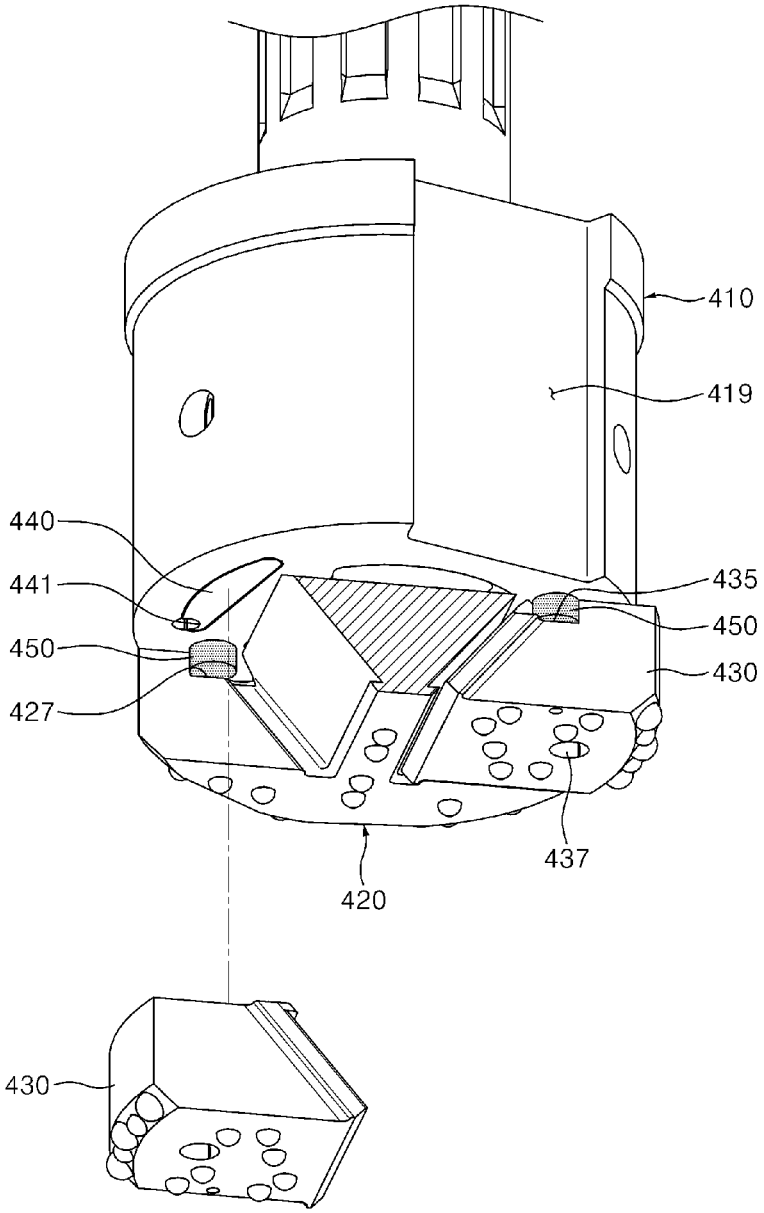
FIG. 25 is a perspective view illustrating a position of a stopper in the moved up state of the wing bit of the hammer bit of FIG. 24.
Figure 26:
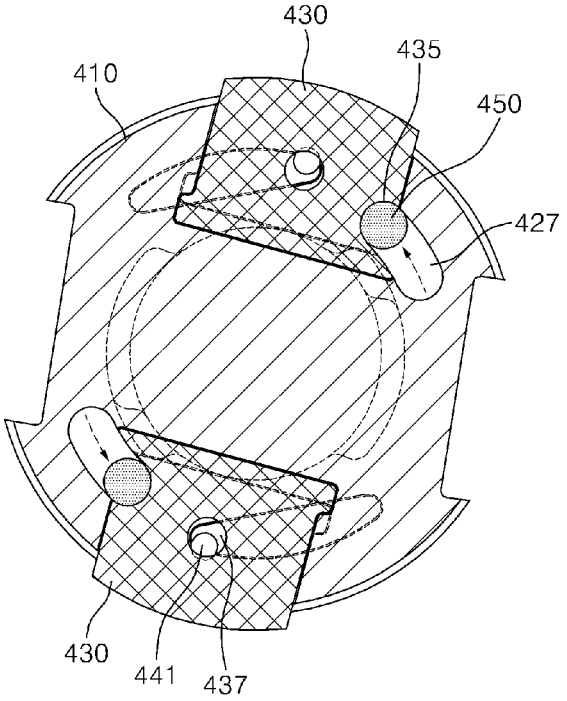
FIG. 26 is a cross sectioned perspective view of the position of the stopper in the moved up state of the wing bit of the hammer bit of FIG. 25.
Figure 27:
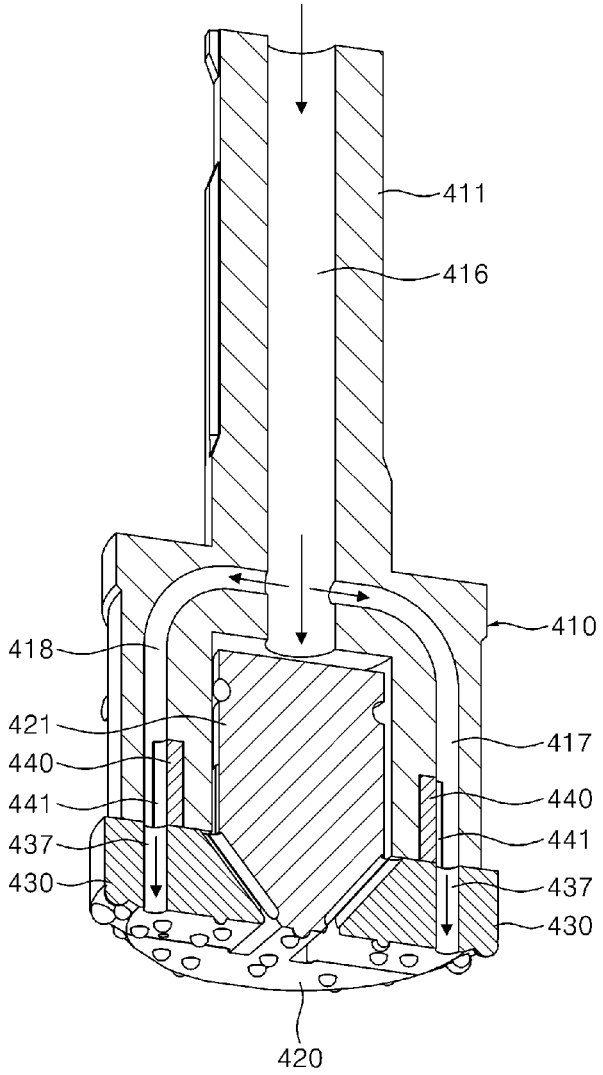
FIG. 27 is a cross-sectioned perspective view illustrating a moved up state of the wing bit of the hammer bit of FIG. 25.

FIG. 24 is a perspective view illustrating a moved up state of the wing bit of the hammer bit of FIG. 19, FIG. 24 is a perspective view illustrating a position of a stopper in the moved up state of the wing bit of the hammer bit of FIG. 24, FIG. 26 is a view of the position of the stopper in the moved up state of the wing bit of the hammer bit of FIG. 25, and FIG. 27 is a cross-sectioned perspective view illustrating a moved up state of the wing bit of the hammer bit of FIG. 25.

Referring to FIGS. 24 to 27, when the wing bits 430 contact the ground, the wing bits 430 are pressurized and thus the wing bits 430 and the spacers 440 move upward. At this point, undersurfaces of the housing bit 420 and the wing bits 430 are located at an almost same plane.

When the hammer bit 400 rotates in a direction, the bit body 410 rotates in a direction at a predetermined angle while the housing bit 420 and the wing bit 430 do not rotate. At this point, the stoppers 450 of the bit main body 410 move to the hanging groove 435 of the wing bits 430 and thus the wing bits 430 are caught by the stoppers 450 not to move down but to be stably fixed.

Therefore, the fluctuation of the wing bits 430 in a vertical direction due to an irregular excavating surface can be prevented during the housing bit 420 and the wing bits 430 rotate for the excavation. In addition, since the wing bits 430 are stably fixed during the excavation of the hammer drill 10, the damage of the wing bits 430 can be minimized.

In addition, since the wing bits 430 more protrude outward than outer circumferences of the bit body 410 and the reclamation pipe 20, the rotating radius of the wing bits 430 is more increased than outer diameters of the bit body 410 and reclamation pipe 20.

Further, the exhaust channel 437 of each of the wing bit 430 is connected to the branched channel 417 of the bit body 410 and to the connection channel 441 of the corresponding spacer 440. In addition, when the exhaust channel 428 is formed on the housing bit 420, the exhaust channel 428 of the housing bit 420 is connected to the branched channel 418 of the bit body 410. Therefore, even when the bit body 410 rotates relative to the housing bit 420 and the wing bit 430 rotate, the air can be exhausted through the housing bit 420 or/and the wing bit 430.

Since the stopper 450 can prevent the wing bit 430 from fluctuating in the vertical direction, the air can be stably supplied to the exhaust channel 437 of the wing bit 430. Therefore, the excavated soil and crushed rocks can be stably discharged to an external side through the reclamation pipe 20.

When the hammer bit 400 rotates in the moved up state of the wing bit 430, a greater hole than a diameter of the reclamation pipe 20 is bored by the wing bit 430. Therefore, the reclamation pipe 20 can be inserted into the ground by a depth excavated by the hammer bit 400.

Since the sludge discharge groove 419 of the bit body 410 is connected to the sludge discharge groove 429 of the housing bit 420, the air exhausted from the wing bits 430 is exhausted together with the excavated soil or crushed rocks to an upper side of the reclamation pipe 20 through the sludge discharge groove 429 of the bit body 410. Therefore, the hammer drill 10 can keep boring the hole without receiving the resistance generated by the excavated soil or crushed rocks.

Further, since the slope guide 423 of the housing bit 420 supports the wing bit 430 while surface-contacting the corresponding wing bit 430, the coupling strength of the housing bit 420 and the wing bit 430 can be enhanced. Therefore, the damage of the wing bit 430 at the hammer bit 400 can be minimized.

Meanwhile, when the excavation is finished or the hammer bit 400 is worn, the hammer bit 400 may be lifted.

Referring to FIGS. 20 to 23, when the hammer bit 400 rotates at a predetermined angle in a direction opposite to the direction in which the hammer bit rotates during the excavation, the bit body 410 rotates at a predetermined angle in an opposite direction while the housing bit 420 and the wing bits 430 do not rotate. At this point, since the stoppers 450 of the bit main body 410 move from the hanging grooves 435 of the wing bits 430 to the shelter grooves 427 of the housing bit 420, the restriction of the wing bits 430 is released.

When the bit body 410 is lifted, each of the wing bits 430 moves down by the self-gravity and thus the rotating radius of each of the wing bits 430 is more decreased than the inner diameter of the reclamation pipe 20. Therefore, the hammer bit 400 can be withdrawn by being lifted.

Although the indirect excavation method where the hammer bit is inserted in the reclamation pipe is described in the above-described embodiments, the hammer bit of the present invention can be applied to the direct excavation method, for the hammer bit has a larger rotating radius than the bit body during the excavation and has a smaller rotating radius than the housing bit during the withdrawal.

While the present invention has been shown and described in connection with the exemplary embodiments, it will be apparent to those skilled in the art that modifications and variations can be made without departing from the spirit and scope of the invention as defined by the appended claims.

Industrial Applicability

According to the present invention, the hammer bit can be easily withdrawn and the damage of the hammer bit can be minimized. Therefore, the industrial applicability of the present invention is so high.

The invention claimed is:

1. A hammer bit, comprising:

a bit body coupled to a hammer drill;

a housing bit connected to the bit body;

at least one wing bit coupled to the housing bit to move up and down along a plane slanted relative to a longitudinal axis of the hammer bit;

at least one guide groove formed in the bit body at a lower portion thereof; and at least one spacer formed at a top of the wing bit to slide within the guide groove in a direction of the longitudinal axis of the hammer bit, wherein the housing bit is coupled to the bit body to rotate at a predetermined angle, and at least one stopper is formed on an end portion of the bit body; wherein the stopper hangs the wing bit to prevent the wing bit from moving down when the bit body rotates at a predetermined angle; wherein a hanging groove is formed on the wing bit, the stopper moving to the hanging groove when the bit body rotates at a predetermined angle so that the stopper prevents the wing bit from moving down slantly.

2. The hammer bit of claim 1, wherein a shelter groove is formed on the housing bit and is connected to the hanging groove, the stopper moving from the hanging groove to the shelter groove when the bit body rotates at an opposite direction so that the stopper allows the wing bit to move down.

3. The hammer bit of claim 1, wherein a slope portion is formed on the housing bit, and a slope slider is formed on the wing bit to correspond to the slope portion.

4. The hammer bit of claim 3, wherein each protrusion is formed on the slope portion of the housing bit and on the slope slider of the wing bit to prevent the wing bit from falling downward.

5. The hammer bit of claim 1, wherein an arc-shaped reception groove is formed in the bit body, and an arc-shaped clamping portion is formed on the housing bit, the arc-shaped clamping portion having a smaller size than the reception groove so that it is inserted into the reception groove to be capable of rotating at a predetermined angle.

6. The hammer bit of claim 1, wherein a cylindrical reception groove is formed in the bit body, and a cylindrical clamping portion is formed on the housing bit so that it is inserted into the reception groove.

7. The hammer bit of claim 1, wherein at least one air channel is formed in the bit body and the housing bit to supply air from the hammer drill, and at least one exhaust channel is formed in the wing bit to communicate with the air channel when the housing bit rotates at a predetermined angle.

8. The hammer bit of claim 1, wherein at least one discharge groove is formed in outer surfaces of the bit body and the housing bit, the discharge groove of the housing bit communicating with the discharge groove of the bit body when the housing bit rotates at a predetermined angle so as to discharge excavated materials upwards.

9. The hammer bit of claim 1, wherein the wing bit is inserted from an upper side of the housing bit.

10. The hammer bit of claim 1, wherein a lower surface of the wing bit is arranged in parallel to a lower surface of the housing bit when the wing bit moves up.

11. A hammer bit, comprising:

a bit body coupled to a hammer drill and inserted into a reclamation pipe;

a housing bit disposed to the bit body and having a slope portion formed thereon;

at least one wing bit having a slope slider formed thereon to correspond to the slope portion of the housing bit, and having a rotating radius that is larger than an inner diameter of the reclamation pipe when moving up along a slope portion of the housing bit and is smaller than the inner diameter of the reclamation pipe when moving down along the slope portion of the housing bit; and at least one stopper disposed on the bit body, wherein the stopper catches the wing bit to prevent the wing bit from moving down when the bit body rotates at a predetermined angle.

12. The hammer bit of claim 11, wherein a hanging groove is formed on the wing bit, the stopper moving to the hanging groove when the bit body rotates at a predetermined angle so that the stopper prevents the wing bit from moving down slantly.

13. The hammer bit of claim 12, a shelter groove is formed on the housing bit and is connected to the hanging groove, the stopper moving from the hanging groove to the shelter groove when the bit body rotates at an opposite direction so that the stopper allows the wing bit to move down.

14. The hammer bit of claim 11, wherein a guide groove is formed in the bit body to correspond to the wing bit, and a spacer is further provided in the guide groove, the spacer being installed to move up and down together with the wing bit and filling up an upper space of the wing bit when the wing bit moves down.

15. The hammer bit of claim 11, wherein a protrusion is formed on the slope portion of the housing bit and on the slope slider of the wing bit to prevent the wing bit from falling downward.

16. The hammer bit of claim 11, wherein an arc-shaped reception groove is formed in the bit body, and an arc-shaped clamping portion is formed on the housing bit, the arc-shaped clamping portion having a smaller size than the reception groove so that it is inserted into the reception groove to be capable of rotating at a predetermined angle.

17. The hammer bit of claim 11, wherein a cylindrical reception groove is formed in the bit body, and a cylindrical clamping portion is formed on the housing bit so that it is inserted into the reception groove.

18. The hammer bit of claim 11, wherein at least one air channel is formed in the bit body and the housing bit to supply air from the hammer drill, and at least one exhaust channel is formed in the wing bit to communicate with the air channel when the housing bit rotates at a predetermined angle.

19. The hammer bit of claim 11, wherein at least one discharge groove is formed in outer surfaces of the bit body and the housing bit, the discharge groove of the housing bit communicating with the discharge groove of the bit body when the housing bit rotates at a predetermined angle so as to discharge excavated materials upwards.

20. The hammer bit of claim 11, wherein the wing bit is inserted from an upper side of the housing bit.

21. The hammer bit of claim 11, wherein a lower surface of the wing bit is arranged in parallel to a lower surface of the housing bit when the wing bit moves up.

* * * * *